US006668915B1

(12) United States Patent
Materna

(10) Patent No.: US 6,668,915 B1
(45) Date of Patent: Dec. 30, 2003

(54) OPTIMIZED FINS FOR CONVECTIVE HEAT TRANSFER

(76) Inventor: Peter Albert Materna, 81 Rector St., Metuchen, NJ (US) 08840-1540

( * ) Notice: Subject to any disclaimer, the term of this patent is extended or adjusted under 35 U.S.C. 154(b) by 0 days.

(21) Appl. No.: 09/671,531

(22) Filed: Sep. 27, 2000

Related U.S. Application Data

(60) Provisional application No. 60/156,364, filed on Sep. 28, 1999.

(51) Int. Cl.[7] ..... F28F 13/00; F28F 7/00

(52) U.S. Cl. ..... 165/146; 165/185; 165/903

(58) Field of Search ..... 165/146, 147, 165/185, 903, 80.3; 361/697

(56) References Cited

U.S. PATENT DOCUMENTS

| | | | | | |
|---|---|---|---|---|---|
| 4,049,051 | A | * | 9/1977 | Parker | 165/146 |
| 4,653,572 | A | * | 3/1987 | Bennett et al. | 165/146 |
| 4,693,307 | A | | 9/1987 | Scarselletta | |
| 4,730,233 | A | * | 3/1988 | Osterman | 361/693 |
| 4,765,397 | A | * | 8/1988 | Chrysler et al. | 165/146 |
| 4,869,313 | A | | 9/1989 | Fredley | |
| 4,899,810 | A | | 2/1990 | Fredley | |
| 4,953,634 | A | | 9/1990 | Nelson | |
| 5,002,123 | A | | 3/1991 | Nelson | |
| 5,062,411 | A | | 11/1991 | Karabin | |
| 5,109,919 | A | * | 5/1992 | Sakuma et al. | 165/182 |
| 5,437,328 | A | * | 8/1995 | Simons | 165/146 |
| 5,613,552 | A | * | 3/1997 | Osakabe et al. | 165/80.3 |
| 5,709,264 | A | * | 1/1998 | Sweeney et al. | 165/146 |
| 5,818,694 | A | * | 10/1998 | Daikoku et al. | 165/80.3 |
| 5,860,472 | A | * | 1/1999 | Batchelder | 165/185 |
| 6,116,335 | A | | 9/2000 | Beamer | |
| 6,118,656 | A | | 9/2000 | Wang | |
| 6,161,613 | A | | 12/2000 | Huenniger | |
| 6,234,239 | B1 | | 5/2001 | Azar | |
| 6,269,002 | B1 | * | 7/2001 | Azar | 165/80.3 |
| 6,308,771 | B1 | * | 10/2001 | Tavassoli | 165/80.3 |

* cited by examiner

*Primary Examiner*—Henry Bennett
*Assistant Examiner*—Tho Duong
(74) *Attorney, Agent, or Firm*—Peter Materna

(57) ABSTRACT

An arrangement of fins or other convective heat transfer surfaces which provides an improved value of heat transfer per unit pressure drop of the flowing fluid, for a defined geometric envelope. There are at least two flowpaths in parallel. Each flowpath contains a wide densely-surfaced region, called a heat transfer region, which accomplishes heat transfer at a reduced velocity whereby the ratio of heat transfer to pressure drop for that region is improved. In series with that region, in the same flowpath, is a narrow sparsely-surfaced region, called a fluid flow region, which serves to transport the fluid, at higher velocity but with minimal pressure drop, through the region(s) not densely-surfaced. The respective wide and narrow regions can be oppositely placed so that the overall arrangement maintains a constant width dimension so as to resemble conventional design. The invention is applicable to both forced and natural convection, and to laminar transition or turbulent flow, and is particularly applicable to gas side heat exchange.

25 Claims, 13 Drawing Sheets

Contour plot of improvement factor for laminar flow

Contour plot of improvement factor
for turbulent flow

OPTIMIZED FINS FOR CONVECTIVE HEAT TRANSFER

This application claims the benefit of provisional application 60/156,364 filed Sep. 28, 1999.

FIELD OF THE INVENTION

This invention pertains to the field of convective heat transfer.

BACKGROUND OF THE INVENTION

In the field of convective heat transfer, there is in general a tradeoff between heat transfer and pumping power. Power to run a pump or fan to move the fluid involved in heat transfer is usually an expense associated with achieving heat transfer. This is especially of concern in heat exchangers in which the fluid on at least one side is gas such as atmospheric air. Gas side heat exchange is characterized by a relatively small heat transfer coefficient and a relatively small volumetric heat capacity of the gas. Gas side heat exchange designs make up for these drawbacks with large heat transfer surface area and large volumetric flowrate of gas, which together can require a significant amount of power to move the gas. Furthermore, simple fans are frequently inefficient at converting electrical power to gas motion. All of this is especially true when, as is usually the case, there are limitations on the overall space occupied by the heat exchanger. Applications include liquid-to-gas heat exchangers, gas-to-gas heat exchangers, evaporators, condensers, air conditioning and heating equipment, vehicular radiators, heat sinks for electronics, process equipment, electrical generating plants in which the circulating fluid is gas, electrical generating plants which reject heat to the atmosphere, etc. It is also applicable to non-gas heat exchange.

This tradeoff has led to many investigations, both theoretical and empirical, of designs of fins and related geometries. A discussion of this tradeoff is given in "Compact Heat Exchangers" by Kays and London. U.S. Pat. No. 5,738,168 also discusses this tradeoff. This patent uses louvers to locally break up the fluid boundary layer and cause mixing of fluid near heat transfer surfaces without causing a large effect on overall pressure drop. Such an approach is typical of the field of enhanced heat transfer. Approaches such as these have resulted in designs of reasonably satisfactory heat exchangers, radiators, etc. However, there is always room for improvement in regard to the tradeoff between heat transfer and pumping power. Such improvement would increase the efficiency, however it might be defined, of any of the various devices employing forced convection heat transfer or even natural convection heat transfer. So far no designs have considered nonuniform distribution of fins as a way of obtaining a more advantageous situation than is obtained with uniform distribution of fins.

OBJECTS OF THE INVENTION

Accordingly, it is an object of the invention to achieve, within a constrained geometric envelope of space available for heat transfer surface, increased heat transfer for a given fluid pumping power, or, conversely, reduced fluid pumping power for a given amount of heat transfer.

It is further an object of the invention to achieve similar benefits in natural convection heat transfer, such as a smaller temperature difference between the source and the fluid, for a given amount of heat transfer, using only minor changes in the design of fins, compared to conventional uniformly-spaced fins.

SUMMARY OF THE INVENTION

The present invention is a design of fins which, for fixed overall geometrical envelope, produces an improved amount of heat transfer per unit of pressure drop. In contrast to conventional technology, the present invention does not have a uniformly-spaced pattern of fins. Instead, the heat transfer region has at least two flowpaths in parallel. Each flowpath is a series combination of a lower-velocity region and a higher-velocity region, with the lower-velocity region serving especially to accomplish heat transfer by having a significant concentration of heat transfer surface area, and the higher velocity region serving to transport the fluid the rest of the way with relatively little pressure drop by having a relatively small concentration of heat transfer surface area. Thus, most of the heat transfer is accomplished to lower-velocity flow because heat transfer to lower-velocity flow yields a better ratio of heat transfer to pressure drop than does heat transfer to higher-velocity flow. Compared to conventional design, when the geometry is planar the present invention is a replumbing, in at least one place, which changes the series or parallel relationship among various passageways, combined with a shifting of positions of fins in the sideways direction (perpendicular to the fin surface).

DESCRIPTION OF THE DRAWINGS

The invention is described in the following drawings.

DETAILED DESCRIPTION OF THE INVENTION

Figure 1A:
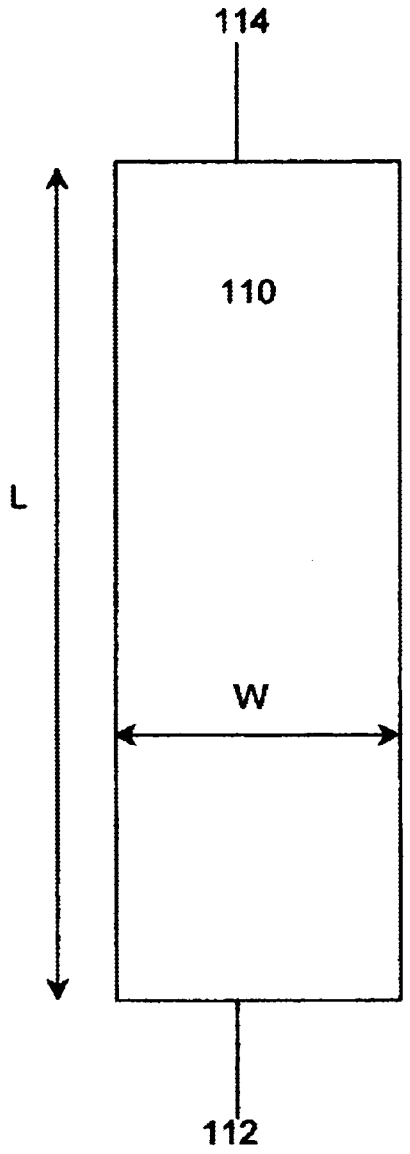
FIG. 1a (Prior Art)
FIG. 1*a* is a schematic illustration of the flow region for conventional design.

In order to understand the present invention and how it improves on conventional design, it is useful to describe some properties of fluid flow and heat transfer, especially in internal flows. The major flow regimes in fluid mechanics are laminar flow and turbulent flow, with a somewhat vaguely-defined transition region between them. The flow regime is determined principally by the Reynolds number, which is density*velocity*characteristic dimension/viscosity. Situations of practical interest to heat transfer include all three of these flow regimes. For air cooling of small objects such as might be driven by a simple fan (for example, distance between fins of several millimeters, air flow velocity of several m/s), the flow would tend to be in the laminar regime. Air cooling at larger velocities or of larger objects would more likely be turbulent. For water cooling, the flow also might tend to be turbulent. Transition regime flow could also occur with either air or water, and of course flows of other fluids are possible also.

Frequently in heat exchanger work the geometry of flow between parallel plates either is the actual geometry or can be used as a close approximation. In all of the analytical calculations herein, fully developed incompressible flow between parallel plates is assumed for simplicity. For the numerical examples presented herein the heat transfer surfaces are referred to as fins, which are substantially flat solid surfaces in heat transfer relationship with a fluid. This is not meant to imply that there are any temperature gradients within the solid material of the fins, as is sometimes the case with fins. In these calculations place-to-place variations of temperature (internal temperature gradients within the fins) are ignored for simplicity of calculation. The word fin is used simply to denote a flat smooth surface at a temperature different from the local temperature of the flowing fluid, capable of transferring heat either to or from the fluid. For laminar fully developed incompressible flow between parallel plates, the flow is described by $$V=(dp/dL)*d\hat{}2/(12*mu)$$

$$\text{Deltap}=V*L*12*mu/d\hat{}2$$

where (dp/dL) is pressure drop per unit of length along the flow direction, d is the gap dimension or height of the flow channel (distance between the surfaces of the parallel plates) perpendicular to the direction of flow, L is the length of the channel along the direction of flow, mu is viscosity, and V is velocity averaged over the flow cross-section (i.e., volumetric flowrate divided by flow cross-sectional area). This equation says that the velocity varies as the square of the gap dimension, or the pressure drop varies inversely with the square of the gap dimension.

In addition to this relation between velocity and pressure drop, a simple heat transfer relation exists to describe the heat transfer coefficient for fully developed laminar flow between parallel plates. In this situation the Nusselt number Nu has essentially a constant value of approximately 7. This means that the local heat transfer coefficient h is given by $$h=Nu*k\text{fluid}/d=7*k\text{fluid}/d$$

where h is the local heat transfer coefficient, kfluid is the thermal conductivity of the fluid, and d is again the gap dimension or height of the flow channel. This means that the local heat transfer coefficient is independent of velocity, and the only design variable influencing the heat transfer coefficient is the separation distance between the parallel plates. The heat transfer coefficient varies inversely with the separation distance, being greater where the fins are close together and smaller where the fins are further apart. In fully-developed laminar flow there actually is no dependence of the heat transfer coefficient on velocity. This implies that for laminar flow, a large velocity is of no real advantage in terms of heat transfer coefficient, and it does have a penalty in terms of pressure drop. The same heat transfer coefficient can be achieved with the same geometry with slower flow, if there is no other reason requiring faster flow. If it is possible to design for low velocity, this can be used to achieve heat transfer without paying the penalty of pressure drop. However, in conventional design the only way to achieve lower velocity for a given flowrate is to increase overall flow area, which in many heat transfer applications is constrained because of overall size limitations.

An illustrative quantity is the ratio of heat transfer coefficient to pressure drop, h/deltap, which for laminar flow is $$\frac{h}{deltap}=\frac{7*kfluid\ d\hat{}2}{d\ V*L*12*mu}$$

or $7*k_{fluid}*d/(V*L*12*mu)$.

If we focus on the variables of most interest for purposes of design, this quantity is proportional to d/V. This says that for laminar flow the way to obtain good h/deltap is for the heat transfer to take place a low velocity. This is why in the present invention we arrange for most of the heat transfer to take place in the lower-velocity portion of the design. The other suggestion from this formula is to have the heat transfer take place at large separation distance. Because of assumed space constraints we are not able to satisfy that suggestion. In fact, in order to obtain a substantial reduction in velocity in the heat transfer portion of the design, we actually vary the spacing slightly in the undesirable direction. However, the benefit from the significant change in velocity outweighs the negative effects from the slight change in separation distance.

For turbulent flow, the relation between velocity V (averaged over the cross-section) and pressure drop deltap is given by $$\text{deltap}=f*(L/D_h)*0.5*\text{rho}*V\hat{}2$$

where the hydraulic diameter $D_h$ equals d/2, i.e., half of the gap dimension (distance from fin surface to adjacent fin surface), and rho is fluid density, L is length along the flow direction and f is friction factor, or $$V\hat{}2=\text{deltap}\ *0.5*d/(f*L/(0.5*\text{rho}))$$

$$V=\text{sqrt}(\text{deltap}\ *d/(f*L*\text{rho}))=\text{sqrt}((\text{deltap}/L)*d/(f*\text{rho}))$$

In turbulent flow the friction factor f is given by the Moody diagram and has an approximately constant value for a given surface roughness, especially in the limit of high Reynolds number. Thus, for turbulent flow, at constant overall pressure drop, the velocity increases with gap dimension but much less strongly than in laminar flow, i.e., velocity increases as (gap dimension)^0.5 rather than as gap dimension to the second power.

In fully-developed turbulent flow, the heat transfer coefficient is given by a correlation such as the Dittus-Boelter correlation $$Nu=0.023*Re\hat{}0.8*Pr\hat{}0.4,\ \text{or}$$

$$h*d/k\text{fluid}=0.023*(\text{rho}*V*d/mu)\hat{}0.8*Pr\hat{}0.4,\ \text{or}$$

$$h\ \text{is proportional to}\ V\hat{}0.8*d0.8/d\ \text{or}\ V\hat{}0.8*d\hat{}-0.2$$

(Pr is the Prandtl number.)

Thus, for turbulent flow the heat transfer coefficient depends on both the gap dimension and velocity. With respect to gap dimension, the dependence is in the same direction as with laminar flow but much more gentle. With respect to velocity, the dependence is just slightly less than linear, in contrast to the complete lack of dependence in laminar flow.

For turbulent flow, just as before with laminar flow, it is useful to examine the functional dependence of the ratio h/deltap.

$$\frac{h}{deltap} = \frac{rho\hat{}0.8 * Velocity\hat{}0.8 * d\hat{}0.8}{mu\hat{}0.8\ rho * Velocity\hat{}2 * L/d}$$

If we focus on the variables of most interest for purposes of design, h/deltap is proportional to d^1.8/Velocity^1.2. This says that for turbulent flow, just as before, the way to obtain good h/deltap is for the heat transfer to take place a low velocity, which is accomplished in the design of the present invention. As before, the formula also suggests having the heat transfer take place at large separation distance, which is not possible when working within assumed space constraints. Again, the design of the present invention provides a substantial reduction in velocity in the heat transfer portion of the design, which is achieved by slightly varying the fin-to-fin spacing in the undesirable direction. Again, the benefit from the significant change in velocity outweighs the negative effects from the slight change in separation distance.

In any of these flow regimes it is also necessary to understand conjugate heat transfer, a situation where the fluid temperature varies with position along the direction of fluid flow, as a result of heat transfer. For flow with heat transfer in a channel of uniform cross-section, with constant wall temperature, there is an exponential approach of the fluid temperature from the inlet fluid temperature to the wall temperature. This exponential approach is described by a characteristic time or distance. The variation of fluid temperature as a function of position is given by $$T(x)=T\text{wall}+(\text{Tinlet}-\text{Twall})*\exp(-x/Lc)$$

$$Lc=V*\text{crosssecarea}*\text{rho}*Cp/(h*\text{perimeter})$$

where Twall is the wall temperature, Tinlet is the fluid inlet temperature, x is distance along the flow direction measured from the fluid inlet, Lc is the characteristic length, V is the fluid velocity averaged over the fluid flow cross-section, crosssecarea is the flow cross-sectional area, rho is the fluid density, Cp is the fluid heat capacity, h is the heat transfer coefficient, and perimeter is the perimeter of the flow channel cross-section exposed to the fluid for heat transfer. For parallel plates of arbitrarily large dimension in the unused direction (perpendicular to the flow direction and to the separation distance between the plates), the characteristic length reduces to Lc=V *rho*Cp*d/(2*h). If the flowpath length is one characteristic length, the fluid exiting temperature changes from its entrance temperature by 63% of the difference between the fin temperature and the fluid entering temperature.

This conjugate heat transfer aspect is one reason for the intuitive belief that at a fixed geometry higher velocity produces in some sense better heat transfer. At larger velocity the fluid will penetrate further into the array before thermally equilibrating with the fin, or will be closer to its supply (inlet) temperature when exiting, or will be generally closer to the supply (inlet) temperature everywhere in the flowpath than it would for a smaller velocity or flowrate. Having fluid temperature, on average, closer to the supply (inlet) temperature results in a greater average temperature difference between the wall and the fluid so as to drive the heat transfer, and hence results in more heat transfer. In laminar flow, where the heat transfer coefficient is velocity-independent, this is the only advantage of higher velocity. In turbulent flow, where the heat transfer coefficient increases with velocity, the improvement of heat transfer coefficient is an important effect The improvement just discussed of penetration distance of fluid is still operative but, because of the variation of heat transfer coefficient, to a lesser extent than in laminar flow.

Figure 1B:
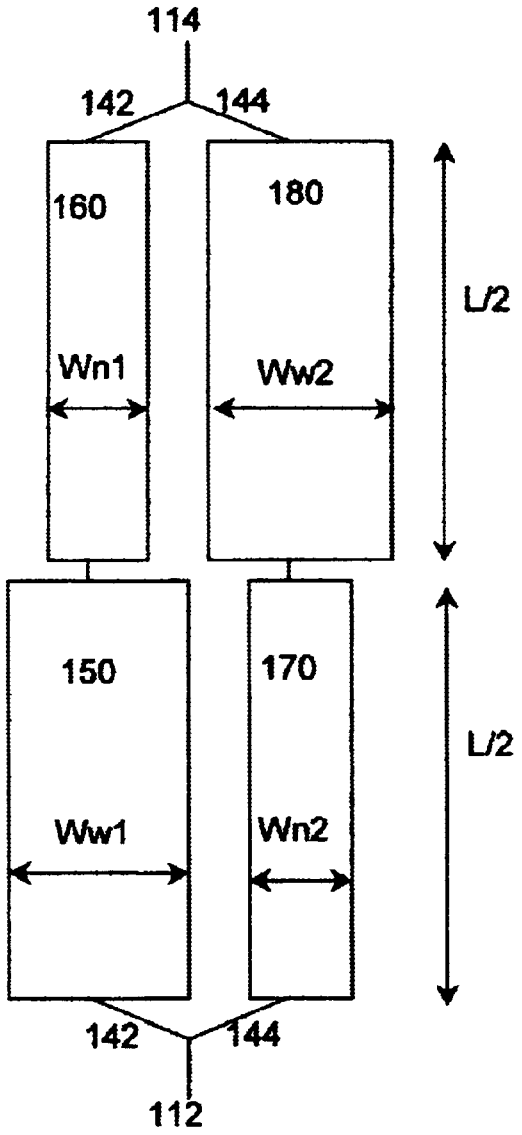
FIG. 1*b* is a schematic illustration of the flow regions for the improved design.

The conventional design is shown schematically in FIG. 1*a*, and the improved design of the present invention is shown schematically in FIG. 1*b*. All regions in this figure may be assumed to be planar, extending indefinitely into and out of the plane of the paper. FIG. 1*a* shows a heat transfer region 110 having a uniform width W and a length L. Flow of fluid enters through an entrance 112 and leaves through an exit 114. Although it is not depicted in FIG. 1*a*, within region 110 there is an essentially uniform distribution of heat transfer surface area across the flow cross-section. The most common heat transfer geometry would be fins, and uniform distribution of heat transfer surface refers to identical fins with uniform spacing between fins. FIG. 1*b* shows the improved design which also comprises an entrance 112 and an exit 114, but further comprises a subdivision into a first flowpath 142 and a second flowpath 144 which are fluid mechanically in parallel with each other. The first flowpath 142 is itself divided into two regions 150 and 160 which are fluid mechanically in series with each other. The second flowpath 144 is divided into two regions 170 and 180 which are fluid mechanically in series with each other. Regions 150, 160, 170 and 180 have lengths Lw1, Ln1, Lw2 and Ln2, respectively. Typically Lw1=Ln1 and Lw2=Ln2 and all of them are approximately equal to half of the length L in FIG. 1*a*. The first flowpath 142 comprises region 150, which is a wider region having a width Ww1, and region 160, which is a narrower region having a width Wn1. Similarly, the second flowpath 144 comprises a narrower region 170 having a width Wn2 and a wider region 180 having a width Ww2. Typically, Wn1=Wn2 and Ww1=Ww2, so that the respective narrower and wider regions add up to give a constant overall width dimension for the array, which corresponds to dimension W in FIG. 1*a*. In fact, according to the symmetry which in many cases would be used, the narrow regions 160 and 170 would be geometrically identical to each other and the wide regions 150 and 180 would be geometrically identical to each other. Because some regions are narrower and others are wider, velocities in the various regions are unequal. Within each individual region 150, 160, 170 and 180, the distribution of heat transfer surface would typically be uniform, but the wide regions 150 and 180 have a different amount of heat transfer surface area per unit of flow cross-sectional area as compared to the narrow regions 160 and 170. It will be seen that for an advantageous situation to be obtained, the amount of heat transfer surface area per unit of flow cross-sectional area is greater for the wide regions 150 and 180 than for the narrow regions 160 and 170. In practical terms for fins, this means that in the wide regions the fins are closer together. By this means, the wide regions serve primarily the purpose of heat transfer and the narrow region serves primarily to move fluid with relatively little pressure drop through the region which is not intended primarily for the purpose of heat transfer. Thus, regions such as 150 and 180 may be referred to herein as heat transfer regions because their primary purpose is to accomplish significant amounts of heat transfer. Regions such as 160 and 170 may be referred to herein as fluid flow regions because they are not intended primarily to accomplish significant amounts of heat transfer but rather are intended to move fluid with minimal pressure drop.

The present invention can be described further with a two-part numerical example comparing a baseline case and an improved design. For comparison, both the baseline and the improved designs will fit into identical overall dimensional envelopes. The numerical example will be presented twice using essentially the same geometry, once for laminar flow and once for turbulent flow. The numerical example is two-dimensional, with the fins being planar and the dimension of the fins in the third dimension (out of the plane of the paper) being arbitrary.

Figure 2A:
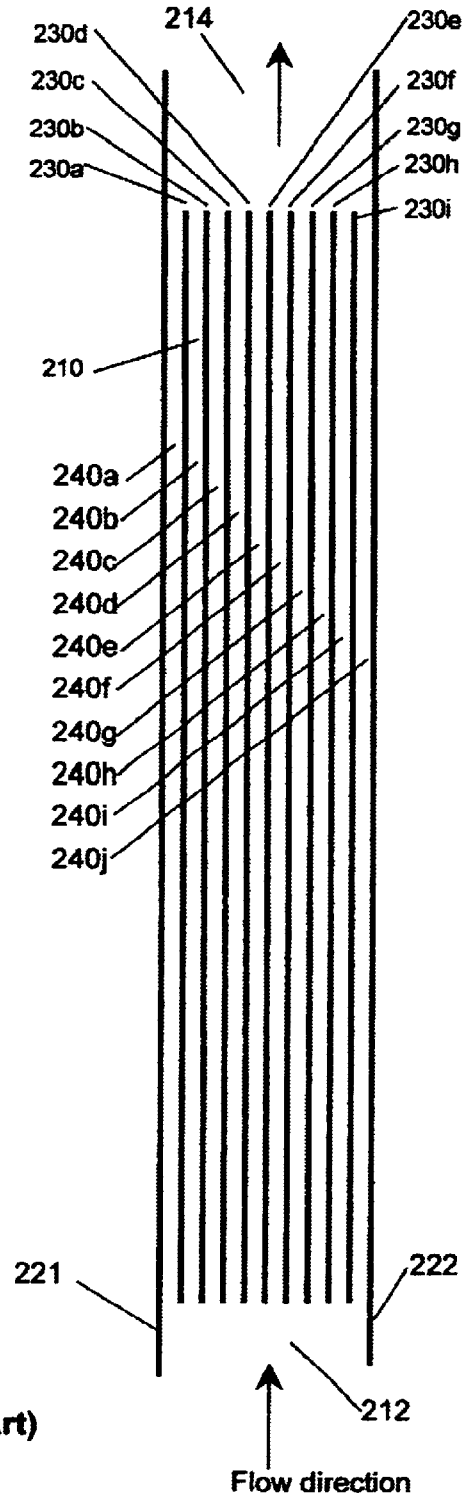
FIG. 2a (Prior Art)
FIG. 2*a* illustrates conventional design for a planar array of fins.

For the baseline laminar flow case, consider a geometry of uniformly spaced flat plate fins, which represents conventional design and is shown in FIG. 2*a*. Parts numbers in FIG. 2 are analogous to those in FIG. 1, with parts numbers being increased by 100. The overall geometry is defined by a left channel boundary 221 and a right channel boundary 222. Between the left channel boundary 221 and right channel boundary 222 is a heat exchange region 210 containing a plurality of fins 230 and a plurality of passageways 240 in parallel with each other. The two channel boundaries 221 and 222 are shown as extending longer than the region with fins so that they define the overall incoming and exiting flow (flow entrance 212 and flow exit 214). For the baseline case it does not matter how many passageways there are in parallel, but for consistency with the later example of improved design it may be assumed that there are ten passageways 240 in parallel. In this example there are nine fins 230A through 230I, which, together with the channel boundaries 221 and 222, define ten passageways 240A through 240J. Each passageway 240 has two heat transfer surfaces which are the surfaces of flat fins 230 or of the channel boundaries 221 and 222. The fins 230 are assumed to be substantially parallel to each other and the passageways 240 are assumed to be of constant cross-section everywhere along their length, with each passageway being identical to the others. In general it does not matter what is the dimension of the fins perpendicular to the flow direction and to the separation dimension. Assume that the spacing between the surfaces is 2.4 mm. For analytical simplicity assume that the surface temperature of the fins is constant everywhere on the fins. Assume that the temperature of the fins is 100 C and the temperature of the entering fluid is 20 C (room temperature). The coolant fluid is assumed to be air entering at approximately atmospheric pressure. Assume that the velocity of the incoming air is 2 m/s. The thermophysical properties of air at room temperature and atmospheric pressure are a density of 1.2 kg/M^3, a heat capacity of 1000 J/kg-K, a thermal conductivity of 0.024 W/m-K and a viscosity of 1.8E-5 kg/m-s. The resulting Reynolds number is 320, which is in the laminar range. The heat transfer coefficient, calculated from the Nusselt number which has a value of 7, is 70 W/m^2-K. It is necessary to assume a length of the flow channel. For sake of example, assume that the length of the passageway is exactly one characteristic length. Thus, the length of the passageway is 41.4 mm. The fluid exit temperature may be calculated using the conjugate heat transfer formulas given earlier. Because the length is exactly one characteristic length, this means that lo in passing through the fin array, the fluid temperature changes by 63% of the difference between the fin temperature and the fluid entering temperature. The fluid exit temperature is 70.6 C. Using the assumption of fully developed laminar flow, the pressure drop across the array is 3.09 Pa. For sake of comparison with later results, the results of this baseline case may be reported also for the midpoint, even though the first half of the passageway and the second half of the passageway are geometrically identical to each other and there is no physical change of geometry at the midpoint. The fluid temperature at the midpoint is 51.5 C. It can be seen that even though the distribution of heat transfer surface area is the same in the upstream half and in the downstream half, more heat transfer occurs in the more upstream half than in the more downstream half, which is typical. Thus the pressure drop spent in the more downstream half is spent less usefully than the pressure drop spent in the more upstream half. For the entire array of fins a figure of merit may be defined as the overall rise in fluid temperature from inlet to exit, divided by the pressure drop. This is 50.6 C divided by 3.09 Pa, or 16.38 C/Pa. The mechanical power of a moving fluid is given by volumetric flowrate times pressure drop. This quantity is 0.148 W per meter of depth out of the plane of the paper. This may be compared to the heat transfer which is 2913 W per meter of depth out of the plane of the paper. The ratio of these two quantities is 19700. These results are summarized in Table 1.

TABLE 1

Calculation parameters for baseline laminar flow case.

| | | |
|---|---|---|
| separation distance d | 0.0024 | m |
| number of flow passageways | 10 | |
| Velocity | 2 | m/s |
| density | 1.2 | kg/m^3 |
| viscosity | 1.80E−05 | kg/m-s |
| Re (=density * velocity * sep dist/viscosity) | 3.20E+02 | |
| Nu | 7 | |
| kfluid | 0.024 | W/m-K |
| heat transfer coefficient h (=Nu * kfluid/d) | 70 | W/m^2-K |
| heat capacity Cp | 1000 | J/kg-K |
| characteristic lgth (=density * heat capacity * velocity * sep dist/(2 * h) | 0.041143 | m |
| length (chosen to be equal to one characteristic length) | 0.041143 | m |
| number of characteristic Lgth (=length/characteristic length) | 1 | |
| inlet temperature | 20 | C. |
| wall temperature | 100 | C. |
| fluid exit temperature (=Twall + (Tinlet − Twall) * exp(−charlengths)) | 70.56964 | C. |
| overall temperature change (=Texit − Tinlet) | 50.56964 | C. |
| deltap (=velocity * length * 12 * viscosity/sepdist^2) | 3.09E+00 | Pa |
| h/deltap | 2.27E+01 | (W/m^2-K)/Pa |
| temperature change/deltap | 1.64E+01 | C/Pa |
| fluid motion power per depth (=velocity * sep dist * number * deltap) | 1.48E−01 | W/m |
| heat transfer per depth (=velocity * sep dist * number * density * Cp * deltaT) | 2912.812 | W/m |
| heat transferred per fluid motion power | 1.97E+04 | |

In constructing the improved design of the present invention, the overall geometric envelope will of course be maintained constant, because that is one of the assumptions of the invention, and so will the total heat transfer surface area.

Figure 2B:
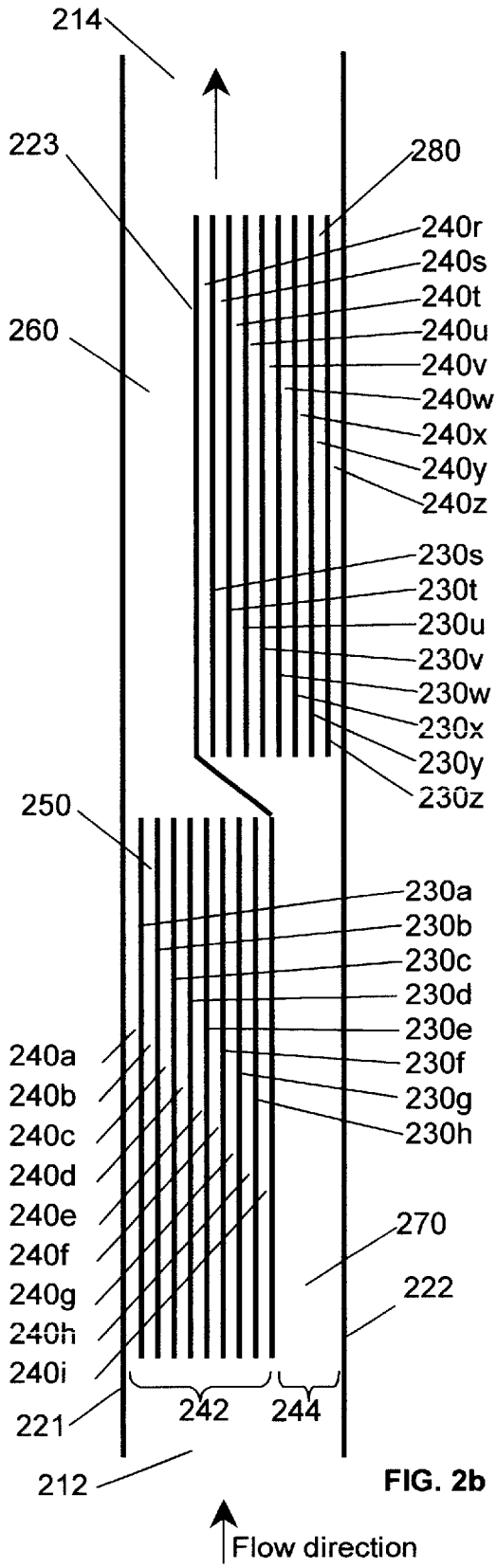
FIG. 2*b* illustrates the improved design for a planar array of fins.

FIG. 2*b* shows the improved design corresponding to the earlier example containing ten identical passageways. The improved design comprises a subdivision into a first flowpath 242 and a second flowpath 244 which are fluid mechanically in parallel with each other. The first flowpath 242 is defined by a left channel boundary 221 and an inter-flowpath boundary 223. The second flowpath 244 is defined by the inter-flowpath boundary 223 and a right channel boundary 222. It will be seen that as a result of symmetries, the flowrates in the first flowpath 242 and the second flowpath 244 are each equal to half of the total flowrate which enters through entrance 212 and exits through exit 214. The first flowpath 242 is itself divided into two regions which are fluid mechanically in series with each other. These two regions are a wider region 250 and a narrower region 260. It may be assumed that the length of each of these regions is half of the overall length. Similarly, the second flowpath 244 comprises a narrower region 270 and a wider region 280 which are fluid mechanically in series with each other. Preferably, the respective narrower and wider regions of different flowpaths add up to give a constant overall dimension for the array. For this example we will assign the first flowpath wide region to have 65% of the flow cross-sectional area and the second flowpath narrow region to have 35% of the total flow cross-sectional area (in contrast to conventional design where if we envisioned it as two separate flowpaths, each flowpath would have half of the flow cross-sectional area). Later on in each flowpath the situation will be reversed. As previously discussed, each flowpath carries half of the total flowrate. Because of this and the varying flow cross-sectional areas, the velocities in the wider and the narrower regions are different, in this case by a factor of 1.85. It is also necessary to assign how much of the heat transfer surface area is in each region. Assume that the wider region has 90% of the heat transfer surface area and the narrow region has 10%. This is accomplished in the present example by having a total of ten passageways, of which each wide region 250 and 280 has nine passageways (region 250 has passageways 240*a* through 240*i*, and region 280 has passageways 240*r* through 240*z*) with nine sets of exposed heat transfer surfaces (region 250 has eight fins 230*a* through 230*h* along with a channel boundary and the inter-flowpath boundary, and region 280 has eight fins 230*s* through 230*z* along with a channel boundary and the inter-flowpath boundary), and each narrow region 260 and 270 has one passageway with one set of exposed heat transfer surfaces. A set of exposed heat transfer surfaces is taken to mean a pair of flat plate surfaces facing each other, which can be any combination of the surfaces of fins or the surfaces of the left channel boundary 222 or the right channel boundary 224 or the inter-flowpath boundary 223. This means that in the wide region the fin-to-fin spacing will be 1.73 mm, slightly closer together than in the baseline case, and in the narrow region the channel width will be 8.4 mm, significantly wider than in the baseline case. Thus, the total number of fins and total heat transfer surface area are the same as in the baseline case. There may be a slight length of fin lost in making the transition between the two flow regions, but this is neglected for this example assuming that the transition region is relatively short compared to the active fin region. In FIG. 2, as in other figures, the length scale of the fin region is not necessarily in proportion to the width dimension.

Using the previously described calculation method, fluid exit temperatures may be calculated for each region respectively. In the region with the 1.73 mm wide flowpaths, the heat transfer coefficient is 96.9 W/m^2-K. In the region with the 8.4 mm wide flowpaths, the heat transfer coefficient is 20 W/m^2-K. First consider the wider then narrower flowpath. The fluid flow in the first and wider portion occupies 1.25 characteristic lengths, so its temperature changes by 71% of the difference between the wall temperature and the gas inlet temperature, giving a fluid exit temperature at the end of the first portion of 77 C. This is already an improvement over the baseline case.) For the subsequent narrower portion of the flowpath, the fluid inlet temperature is the temperature just calculated for the fluid leaving the first part of the flowpath. The second portion of the flowpath occupies occupies 0.03 characteristic lengths, so the fluid temperature changes by 3% of the difference between the starting temperature for that portion and the wall temperature, giving a fluid exit temperature of 77.6 C for the fluid leaving the second and last portion of the flowpath. The pressure drop in the first portion of the flowpath is 2.28 Pa and the pressure drop in the second portion of the flowpath is 0.18 Pa, giving a total pressure drop of 2.46 Pa.

This same calculation may similarly be done for the narrower then wider flowpath. As might be expected, there is a difference in the properties at the midpoint, but the final exit results are identical. For the narrower then wider flowpath, the fluid flow in the narrower part occupies 0.03 characteristic lengths, so its temperature changes by 3% of the difference between the wall temperature and the gas inlet temperature, giving a fluid exit temperature of 22.4 C. For the subsequent wider portion of the flowpath, the fluid inlet temperature is the temperature just calculated for the fluid leaving the narrow part of the flowpath. Here, the fluid flow occupies 1.25 characteristic lengths, so its temperature changes by 71% of the difference between the fluid entering temperature for that portion and the wall temperature, giving a fluid exit temperature of 77.6 C leaving the second and last portion of the flowpath. The pressure drop in the first part of the flowpath is 0.18 Pa and the pressure drop in the second part of the flowpath is 2.28 Pa, giving a total pressure drop of 2.46 Pa. The figure of merit for this improved design may be calculated from a temperature increase of 57.6 C divided by a pressure drop of 2.46 Pa, or 23.4 C/Pa. Compared to the baseline case, there has been more heat transferred and there has been a smaller pressure drop. Compared to the 16.38 C/Pa for the baseline case, this is a 43% improvement in heat transferred per pressure drop (for equal flowrates). The mechanical power of the moving fluid may be calculated as the overall pressure drop times the total volumetric flowrate for both flowpaths. It is 0.118 W per meter of depth dimension out of the plane of the paper. The heat transfer may be calculated from the temperature rise of the fluid exiting both flowpaths. It is 3320 W per meter of depth out of the plane of the paper. The ratio is 28200. This ratio also is a 43% improvement over the corresponding quantity in Table 1. The quantities in this calculation are summarized in Table 2.

TABLE 2

| Parameter values for laminar flow improved design | | |
|---|---|---|
| separation distance or gap for uniformly spaced case | 0.0024 | m |
| number of flow channels for uniformly spaced case | 10 | |
| velocity for uniformly spaced case | 2 | m/s |
| flow area fraction in first region (wider region) | 0.65 | |
| heat transfer area fraction in first region | 0.9 | |
| number of flow channels in first region | 9 | |
| separation distance d (=uniform gap * flow area frac/ht tr area frac) | 0.00173333 | m |
| Velocity (=0.5 * uniform velocity/flow area fraction first region) | 1.53846154 | m/s |
| density | 1.2 | kg/m^3 |
| viscosity | 1.80E−05 | kg/m-s |
| Re (=density * velocity * sep dist/viscosity) | 1.78E+02 | |
| Nu (=7 for fully developed laminar flow between parallel plates) | 7 | |
| kfluid | 0.024 | W/m-K |
| heat transfer coefficient h (=Nu * kfluid/sepdist) | 96.9230769 | W/m^2-K |
| heat capacity of fluid Cp | 1000 | J/kg-K |
| characteristic length (=density * heat capacity * velocity * sep dist/(2 * h) | 0.01650794 | m |

TABLE 2-continued

| Parameter values for laminar flow improved design | | |
|---|---|---|
| length (=half of length in Table 1) | 0.0205715 | m |
| number of characteristic Lengths (=Length/characteristic Length) | 1.24615817 | |
| inlet temperature | 20 | C. |
| wall temperature | 100 | C. |
| fluid exit temperature (=Twall + (Tinlet − Twall) * exp(−charlengths)) | 76.9913907 | C. |
| deltap (=velocity * length * 12 * viscosity/sepdist^2) | 2.28E+00 | Pa |
| h/deltap | 4.26E+01 | (W/m^2-K)/Pa |
| flow area fraction in second region (narrower region) | 0.35 | |
| heat transfer area fraction in second region | 0.1 | |
| number of flow channels in second region | 1 | |
| separation distance d for second region | 0.0084 | m |
| Velocity (=0.5 * uniform velocity/flow area fraction second region) | 2.85714286 | m/s |
| density | 1.2 | kg/m^3 |
| viscosity | 1.80E−05 | kg/m-s |
| Re (=density * velocity * sep dist/viscosity) | 1.60E+03 | |
| Nu | 7 | |
| kfluid | 0.024 | W/m-K |
| heat transfer coefficient h (=Nu * kfluid/sepdist) | 20 | W/m^2-K |
| heat capacity Cp | 1000 | J/kg-K |
| characteristic lgth (=density * heat capacity velocity * sep dist/(2 * h)) | 0.72 | m |
| length (=half of length in Table 1) | 0.0206 | m |
| number of characteristic Lengths (=Length/characteristic Length) | 0.0286 | |
| inlet temperature (=exit temperature from first region) | 76.9913907 | C. |
| wall temperature | 100 | C. |
| fluid exit temperature (=Twall + (Tinlet − Twall) * exp(−charlengths)) | 77.6394793 | C. |
| deltap (=velocity * length * 12 * viscosity/sepdist^2) | 1.80E−01 | Pa |
| h/deltap | 1.11E+02 | (W/m^2-K)/Pa |
| overall temperature change (Texit second region − Tinlet first region) | 57.6394793 | C. |
| total deltap (=deltap first region + deltap second region) | 2.46E+00 | Pa |
| temperature change/deltap | 2.35E+01 | C/Pa |
| fluid motion power per depth (=2 * (velocity1 * sep1 * number1 * deltap1 + velocity2 * sep2 * number | 1.18E−01 | W/m |
| heat transfer per depth (=2 * velocity * sep dist * number * density * Cp * overall deltaT) | 3.32E+03 | W/m |
| heat transferred per fluid motion power | 2.82E+04 | |

As mentioned, for sake of comparison the heat transfer surface area was maintained constant. The overall integrated total of h (what would be h*Area, a frequently used parameter in heat exchanger design) turned out to be slightly larger for the improved case because in laminar flow the heat transfer coefficient depends only on spacing and most of the fins are closer together. At the same time, the pressure drop for the improved case is smaller than for the baseline case. The densely-surfaced wide part of the flowpath has 98% of the characteristic lengths for heat transfer and 93% of the pressure drop. The sparsely-surfaced narrow part of the flowpath has 2% of the characteristic lengths for heat transfer and 7% of the pressure drop. The flow in the densely-surfaced wide part of the flowpath has a pressure drop not too much larger than that in half of the conventional design because the lower velocity and the slightly squashed-together fin spacing approximately offset each other. The flow in the sparsely-surfaced narrow part of the flowpath has a pressure drop much smaller than that in half of the length of the conventional design because the channel width has changed so as to significantly reduce the pressure drop, while the influence of the velocity change has a more minor influence in the other direction on the pressure drop. The heat transfer is slightly increased for the improved case, the pressure drop is significantly reduced, and the heat transferred per pressure drop is improved (by approximately 43%).

Next, another numerical example is presented, this time for turbulent flow. Here, the fluid used will be water and the geometry will be the same except that the flowpath length will be adjusted so that the baseline design again has one characteristic length, as in the just-completed example.

For the baseline turbulent flow case, consider the same uniformly spaced flat plate fins, which represent conventional design. Again, assume that the temperature of the fins is 100 C, constant everywhere on the fins, and the temperature of the entering fluid is 20 C. Again, assume that the spacing between the plates is 2.4 mm and that there are ten fluid passageways in parallel. Assume that the velocity of the fluid is again 2 m/s. However, assume that the fluid is water instead of air. The thermophysical properties of water at room temperature are a density of 1000 kg/m^3, a heat capacity of 4187 J/kg-K, a thermal conductivity of 0.596 W/m-K and a viscosity of 1.E-3 kg/m-s, and a Prandtl number of 7.2. The resulting Reynolds number is 4800, which is in the turbulent range. The heat transfer coefficient is 11084 W/m^2-K. The physical length of the channel is assumed to be different in this example. As in the previous laminar flow example, for the baseline case the length is chosen so that for the chosen parameter values the length of the flow channel is exactly one characteristic length. Thus, the length of the flowpath is 907 mm. Because of the one characteristic length, the fluid exiting temperature again changes to 63% of the difference between the fin temperature and the fluid entering temperature. The fluid exit temperature is 70.6 C, just as in the laminar baseline case. Using the assumption of fully developed turbulent flow, with a friction factor of 0.02, the pressure drop across the array is 15,100 Pa. For sake of comparison with later results, the results of this baseline case may be reported also for the midpoint, with the fluid temperature at the midpoint again being 51.5 C. For the entire array of fins a figure of merit may be defined as the overall rise in fluid temperature from inlet to exit, divided by the pressure drop. This is 50.6 C divided by 7560 Pa, or 6.7E-3 C/Pa. The mechanical power of the moving fluid is 363 W per meter of depth out of the plane of the paper. The heat transfer is 10.2E6 W per meter of depth out of the plane of the paper. The ratio of these two quantities is 28000. These results are summarized in Table 3.

TABLE 3

| Calculation parameters for baseline turbulent flow case. | | |
|---|---|---|
| separation distance d | 0.0024 | m |
| number of flow channels | 10 | |
| Velocity | 2 | m/s |
| density | 1000 | kg/m^3 |
| viscosity | 1.00E−03 | kg/m-s |
| Re (=density * velocity * sep dist/viscosity) | 4.80E+03 | |
| Pr | 7.20E+00 | |
| Nu (=0.023 * R^0.8 * Pr^0.4) | 4.46E+01 | |
| kfluid | 0.596 | W/m-K |
| h (=Nu * kfluid/sepdist) | 11083.80413 | W/m^2-K |
| heat capacity Cp | 4187 | J/kg-K |
| characteristic lgth (=density * heat capacity * velocity * sep dist/(2 * h) | 0.9066 | m |

TABLE 3-continued

| Calculation parameters for baseline turbulent flow case. | | |
|---|---|---|
| length (chosen to be equal to one characteristic length) | 0.9066 | m |
| number of characteristic Lengths (=Length/characteristic Length) | 1 | |
| inlet temperature | 20 | C. |
| wall temperature | 100 | C. |
| fluid exit temperature (=Twall + (Tinlet − Twall) * exp(−charlengths)) | 70.56964471 | C. |
| overall temperature change (=Texit − Tinlet) | 50.56964471 | C. |
| deltap (=f * (Length/(2 * sep dist)) * 0.5 * density * velocity^2) | 7.56E+03 | Pa |
| h/deltap | 1.47E+00 | (W/m^2-K)/Pa |
| temperature change/deltap | 6.693E−03 | C/Pa |
| fluid motion power per depth (=velocity * sep dist * number * deltap) | 3.63E+02 | W/m |
| heat transfer per depth (=velocity * sep dist * number * density * Cp * delta | 10163285 | W/m |
| heat transferred per fluid motion power | 2.80E+04 | |

The improved design for the turbulent case is geometrically identical to the improved design for the laminar case, except for length. The overall length of the improved design for the turbulent case is the same as the length for the baseline turbulent case. Using the previously described calculation method, water exit temperatures may be calculated for each region respectively. In the region with the 1.73 mm wide flowpaths, the heat transfer coefficient is 9590 W/m^2-K. In the region with the 8.4 mm wide flowpaths, the heat transfer coefficient is 11476 W/m^2-K. (In contrast to the laminar flow case, here the larger of the two heat transfer coefficients occurs in the narrow sparsely-surfaced faster-velocity channel, because in turbulent flow the greatest influence on heat transfer coefficient is velocity.) First consider the wider then narrower flowpath. The fluid flow in the first and wider portion occupies 0.78 characteristic lengths, so its temperature changes by 54% of the difference between the wall temperature and the fluid inlet temperature, giving a fluid exit temperature at the end of the first portion of 63.3 C. For the subsequent narrower portion of the flowpath, the fluid inlet temperature is the temperature just calculated for the fluid leaving the first portion of the flowpath. The second portion of the flowpath occupies 0.10 characteristic lengths, so the fluid temperature changes by 10% of the difference between the starting temperature for that portion and the wall temperature, giving a temperature of 66.9 C for the fluid leaving the second and last portion of the flowpath. The pressure drop in the first portion of the flowpath is 3100 Pa and the pressure drop in the second portion of the flowpath is 2200 Pa, giving a total pressure drop of 5300 Pa.

This same calculation may similarly be done for the narrower then wider flowpath. As was found in the laminar flow example, there is a difference in the properties at the midpoint, but the final exit results are identical. For the narrower then wider flowpath, the fluid flow in the narrower part occupies 0.10 characteristic lengths, so its temperature changes by 10% of the difference between the wall temperature and the fluid inlet temperature, giving a fluid exit temperature of 28 C. For the subsequent wider portion of the flowpath, the fluid inlet temperature is the temperature just calculated for the fluid leaving the narrow part of the flowpath. Here, the fluid flow occupies 0.78 characteristic lengths, so its temperature changes by 54% of the difference between the starting temperature for that portion and the wall temperature, giving a fluid exit temperature of 66.9 C leaving the second and last portion of the flowpath. The pressure drop in the first part of the flowpath is 2200 Pa and the pressure drop in the second part of the flowpath is 3100 Pa, giving a total pressure drop of 5300 Pa. The figure of merit for comparing the improved design to the baseline design may be calculated using results from either of the two parallel flowpaths, since their results are identical. The figure of merit for this improved design may be calculated from a temperature increase of 46.9 C divided by a pressure drop of 5300 Pa, or 8.85E-3 C/Pa. Compared to the 6.7E-3 C/Pa for the baseline case, this is a 32% improvement. The mechanical power of the moving fluid is 254 W per meter of depth out of the plane of the paper. This may be compared to the heat transfer which is 9.42E6 W per meter of depth out of the plane of the paper. The ratio is 37100. This quantity also is a 32% improvement over the corresponding quantity in Table 3. These quantities are summarized in Table 4.

TABLE 4

| Parameter values for turbulent flow improved design | | |
|---|---|---|
| separation distance or gap for uniformly spaced case | 0.0024 | m |
| number of flow channels for uniformly spaced case | 10 | |
| velocity for uniformly spaced case | 2 | m/s |
| flow area fraction in first region (wider region) | 0.65 | |
| heat transfer area fraction in first region | 0.9 | |
| number of flow channels in first region | 9 | |
| separation distance d (=uniform gap * flow area frac/ht tr area frac) | 0.0017333 | m |
| Velocity (=0.5 * uniform velocity/ flow area fraction first region) | 1.5384615 | m/s |
| density | 1000 | kg/m^3 |
| viscosity | 1.00E−03 | kg/m-s |
| Re (=density * velocity * sep dist/viscosity) | 2.67E+03 | |
| Pr | 7.20E+00 | |
| Nu (=0.023 * Re^0.8 * Pr^0.4) | 2.79E+01 | |
| kfluid | 0.596 | W/m-K |
| h (=Nu * kfluid/sepdist) | 9589.5889 | W/m^2-K |
| Cp | 4187 | J/kg-K |
| char lgth (=density * heat capacity * velocity * sep dist/(2 * h)) | 0.5821591 | m |
| length (=half of length in Table 3) | 0.4533 | m |
| number of characteristic Lengths (=Length/char Length) | 0.7786531 | |
| inlet temperature | 20 | C. |
| wall temperature | 100 | C. |
| fluid exit temperature | 63.278091 | C. |
| deltap (=f * (Length/2 * sep dist)) * 0.5 * density * velocity^2) | 3.09E+03 | Pa |
| h/deltap | 3.10E+00 | (W/m^2-K)/Pa |
| flow area fraction in second region (narrower region) | 0.35 | |
| heat transf area fraction in second region | 0.1 | |
| number of flow channels in second region | 1 | |
| separation distance d (=uniform gap * flow area frac/ht tr area frac) | 0.0084 | m |
| Velocity (=0.5 * uniform velocity/flow area fraction second region) | 2.8571429 | m/s |
| density | 1000 | kg/m^3 |
| viscosity | 1.00E−03 | kg/m-s |
| Re (=density * velocity * sep dist/viscosity) | 2.40E+04 | |
| Pr | 7.20E+00 | |
| Nu (=0.023 * Re^0.8 * Pr^0.4) | 1.62E+02 | |
| kfluid | 0.596 | W/m-K |
| h (=Nu * kfluid/sepdist) | 11476.165 | W/m^2-K |
| Cp | 4187 | J/kg-K |
| char lgth (=density * heat capacity * velocity * sep dist/(2 * h) | 4.3781174 | m |
| length (=half of length in Table 3) | 0.4533 | m |
| number of characteristic Lengths (=Length/char Length) | 0.1035377 | |
| inlet temperature (=exit temperature from first region) | 63.278091 | C. |

TABLE 4-continued

| Parameter values for turbulent flow improved design | | |
|---|---|---|
| wall temperature | 100 | C. |
| fluid exit temperature | 66.889982 | C. |
| deltap (=f * (Length/(2 * sep dist0) * 0.5 * density * velocity^2) | 2.20E+03 | Pa |
| h/deltap | 5.21E+00 | (W/m^2-K)/Pa |
| overall temperature change | 4.69E+01 | C. |
| total deltap | 5.30E+03 | Pa |
| temperature change/deltap | 8.851E−03 | C/Pa |
| fluid motion power per depth (=2 * (velocity1 * width1 * deltap1 + velocity2 * width2 * deltap2)) | 2.54E+02 | W/m |
| heat transfer per depth (=2 * density * velocity * width * Cp * overall delta T) | 9.42E+06 | W/m |
| heat transferred per fluid motion power | 3.71E+04 | |

As mentioned, for sake of comparison the heat transfer surface area was maintained constant. The overall integrated total of h (what would be h*Area, a frequently used parameter in heat exchanger design) turned out to be somewhat smaller for the improved than for the baseline case. At the same time, the pressure drop for the improved case is significantly smaller than for the baseline case. The densely-surfaced wide part of the flowpath has 88% of the characteristic lengths for heat transfer and 58% of the pressure drop. The sparsely-surfaced narrow part of the flowpath has 12% of the characteristic lengths for heat transfer and 42% of the pressure drop. The flow in the densely-surfaced wide part of the flowpath has a pressure drop roughly comparable to that in half of the conventional design because the lower velocity and the slightly squashed-together fin spacing approximately offset each other. For the flow in the sparsely-surfaced narrow part of the flowpath, the pressure drop is in a sense wasted because so little heat transfer is accomplished, but the overall h/deltap for the entire array still shows an improvement compared to the baseline turbulent case. Comparing the improved design to the baseline design, the heat transfer surface areas are the same, and the overall integrated heat transfer coefficient (which would be indicative of h*A) is slightly smaller for the improved case, as is the exit temperature of the fluid or the amount of heat actually transferred. If the amount of heat transferred were a design constraint, a slight upward adjustment of the total heat transfer surface area or flowrate would be necessary. The pressure drop is more significantly reduced for the improved case. The heat transferred per pressure drop is improved (by approximately 32%).

Now that these numerical examples have illustrated the principle of the invention, it is possible to generalize the calculation and see more generally how the improvement varies with design variables. The variables which would be selected for this generalization are suggested by the calculation method used in the numerical examples. Two independent variables suffice to describe the parameter space. One variable describes how unevenly the flow cross-sectional area is distributed between the two regions, and the other variable describes how unevenly the heat transfer surface area is distributed between the two regions. The dependent variable is the improvement factor. The improvement factor presented here is the ratio of (heat transferred/deltap) for the improved design divided by the same quantity for the baseline design. The previously presented examples will appear in the tables as just one of many calculational results. For flow area inequality, the relative flow cross-sectional areas in the two regions can be described as percentages which add up to 100% of the total flow cross-sectional area in the combined pair of wide and narrow regions, for example as 65% of the flow cross-sectional area in the wide region and 35% of the flow cross-sectional area in the narrow region, as was used in the numerical example. The fraction in the region having the larger of the two fractions, namely 65%, is what is reported in the axis of the table. Similarly, for heat transfer area inequality, the relative heat transfer surface areas in the two regions can be described as percentages which add up to 100% of the total heat transfer surface area, for example as 90% of the heat transfer surface area in the region having more of the heat transfer surface area and 10% of the heat transfer surface area in the region having less of the heat transfer surface area, as was used in the numerical example. The fraction in the region having the larger of the two fractions, namely 90%, is what is reported in the axis of the table. In all cases reported in the tables, the region having the majority of the flow cross-sectional area is the same region as the region having the majority of the heat transfer surface area.

In order to generate this table it is in principle possible to rerun the spreadsheets of the previous four tables many times. Alternatively, since only dimensionless improvement factors will be presented as results, shorter spreadsheets could be developed incorporating the scaling laws which have already been presented, and using dimensionless parameters. As in the numerical examples already given, there are two cases which will be presented. The first is for laminar flow and the second is for turbulent flow. The results for laminar flow are given in Table 5.

TABLE 5

Improvement factor in heat transfer per unit pressure drop, for laminar flow

| Fraction of heat transfer surface area in region having majority of ht transfer | Fraction of flow cross-sectional area in region having majority of flow cross-sectional area | | | | | | | | | |
|---|---|---|---|---|---|---|---|---|---|---|
| surf area | 50% | 55% | 60% | 65% | 70% | 75% | 80% | 85% | 90% | 95% |
| 95% | 0.73 | 0.94 | 1.17 | 1.42 | 1.69 | 1.93 | 2.07 | 1.89 | 1.09 | 0.19 |
| 90% | 0.78 | 0.99 | 1.21 | 1.43 | 1.61 | 1.67 | 1.46 | 0.94 | 0.36 | 0.05 |
| 85% | 0.82 | 1.03 | 1.23 | 1.39 | 1.44 | 1.31 | 0.96 | 0.51 | 0.17 | 0.02 |
| 80% | 0.86 | 1.05 | 1.21 | 1.29 | 1.23 | 0.99 | 0.64 | 0.31 | 0.1 | 0.02 |
| 75% | 0.9 | 1.07 | 1.18 | 1.17 | 1.02 | 0.75 | 0.45 | 0.21 | 0.07 | 0.01 |
| 70% | 0.94 | 1.07 | 1.11 | 1.04 | 0.84 | 0.58 | 0.34 | 0.16 | 0.05 | 0.01 |
| 65% | 0.96 | 1.05 | 1.04 | 0.91 | 0.7 | 0.47 | 0.27 | 0.13 | 0.04 | 0.01 |
| 60% | 0.98 | 1.03 | 0.96 | 0.8 | 0.59 | 0.38 | 0.22 | 0.1 | 0.03 | 0 |

TABLE 5-continued

| Fraction of heat transfer surface area in region having majority of ht transfer | Improvement factor in heat transfer per unit pressure drop, for laminar flow | | | | | | | | | |
|---|---|---|---|---|---|---|---|---|---|---|
| | Fraction of flow cross-sectional area in region having majority of flow cross-sectional area | | | | | | | | | |
| surf area | 50% | 55% | 60% | 65% | 70% | 75% | 80% | 85% | 90% | 95% |
| 55% | 1 | 0.99 | 0.88 | 0.7 | 0.51 | 0.33 | 0.18 | 0.09 | 0.03 | 0 |
| 50% | 1 | 0.95 | 0.81 | 0.63 | 0.44 | 0.28 | 0.16 | 0.07 | 0.02 | 0 |

In this table the previously presented result for the example calculation appears in the location with the wide portion having a flow area fraction of 65% and having a heat transfer area fraction of 90%, showing an improvement factor of 1.43. In general, the portion of the table having an improvement factor greater than one is approximately the upper left hand corner of the table beginning at or very close to the diagonal which bisects the table. Within the upper left half of the table, there are slight regions which do not show an improvement factor greater than one. In broad terms, this means that, for the improvement factor to be greater than one, the distribution of heat transfer surface area between the two regions must be more skewed than the distribution of flow cross-sectional area between the two regions, i.e., the heat transfer surface area distribution factor must be greater than the flow cross-sectional area distribution factor. For example, if the region having the larger flow cross-sectional area also had exactly 60% of the heat transfer surface area, the improvement factor would be very close to one (actually slightly less than one), but as the concentration of heat transfer surface area in that region increases, the improvement factor is greater than one. As one goes further away from the diagonal in this direction, there is in most cases an improvement factor greater than one. It can be seen that an improvement factor slightly larger than 2 can be obtained for a somewhat extreme situation in which the wide portion of the flowpath has 80% of the flow area and 95% of the heat transfer surface area.

It may be useful to find a more general way of stating the criterion of being in the upper left half of the table. A useful descriptor is the ratio, for a given region, of heat transfer surface area to flow cross-sectional area. This dimensionless variable appears frequently in Kays and London in both heat transfer equations and fluid flow pressure drop equations. (In case there is physically more than one fluid flow region in a given flowpath, they can be lumped together as effectively one fluid flow region for this purpose.) We can describe the diagonal of the table as the place where for the wider region and for the narrower region there is the same amount of heat transfer surface area per unit of flow cross-sectional are. For example, if the distribution of flow cross-sectional area is 65% in the wide region and 35% in the narrow region, and the distribution of heat transfer surface area is 65% in the wide region and 35% in the narrow region, then for the wide region the ratio of heat transfer area to flow area is 65%/65%, and for the narrow region the ratio of heat transfer area to flow area is 35%/35%, which are equal to each other. The criterion for being in the upper left comer of the table is that in the wider region, which is the lower-velocity region, the amount of heat transfer surface area per unit of flow cross-sectional area is greater than it is in the narrow (higher-velocity) region. For example, if the distribution of flow cross-sectional area is 65% in the wide region and 35% in the narrow region, and the distribution of heat transfer surface area is 90% in the wide region and 10% in the narrow region, then for the wide (lower-velocity) region the ratio of heat transfer area to flow area is 90%/65%, and for the narrow (higher-velocity) region the ratio of heat transfer area to flow area is 10%/35%. The ratio 90%/65% for the wide region is obviously greater than the ratio 10%/135% for the narrow region. Thus, this criterion describes being in the upper left half of the table. This criterion is readily applicable for simple fins as has been used in the numerical examples, but it is also useful for generalizing to non-fin heat transfer geometries such as porous meshes, pins, etc. In the numerical examples the left channel boundary 221, the right channel boundary 222 and the inter-flowpath boundary 223 have been assumed to be heat transfer surfaces just like the fins 230. While this is convenient because these surfaces so closely resemble the fins, it is by no means necessary. The term mass flux is also a useful generalization in place of the term velocity. The two terms are equivalent for incompressible flow, but if the flow were compressible, mass flux would be more relevant especially for heat transfer. Mass flux is mass per unit time per unit cross-sectional area.

It is intuitively reasonable that in this table the maximum improvement factor be around 2 because if the velocity is halved and length is halved and residence time stays the same, heat transfer will be roughly the same, but pressure drop, being velocity-dependent, will be halved. This is if we neglect the space for the narrow flowpath adjacent to the densely-surfaced region. In slightly more detail, squeezing the fins slightly together improves the heat transfer coefficient and is responsible for the improvement factor being slightly more than 2.

Figure 3A:
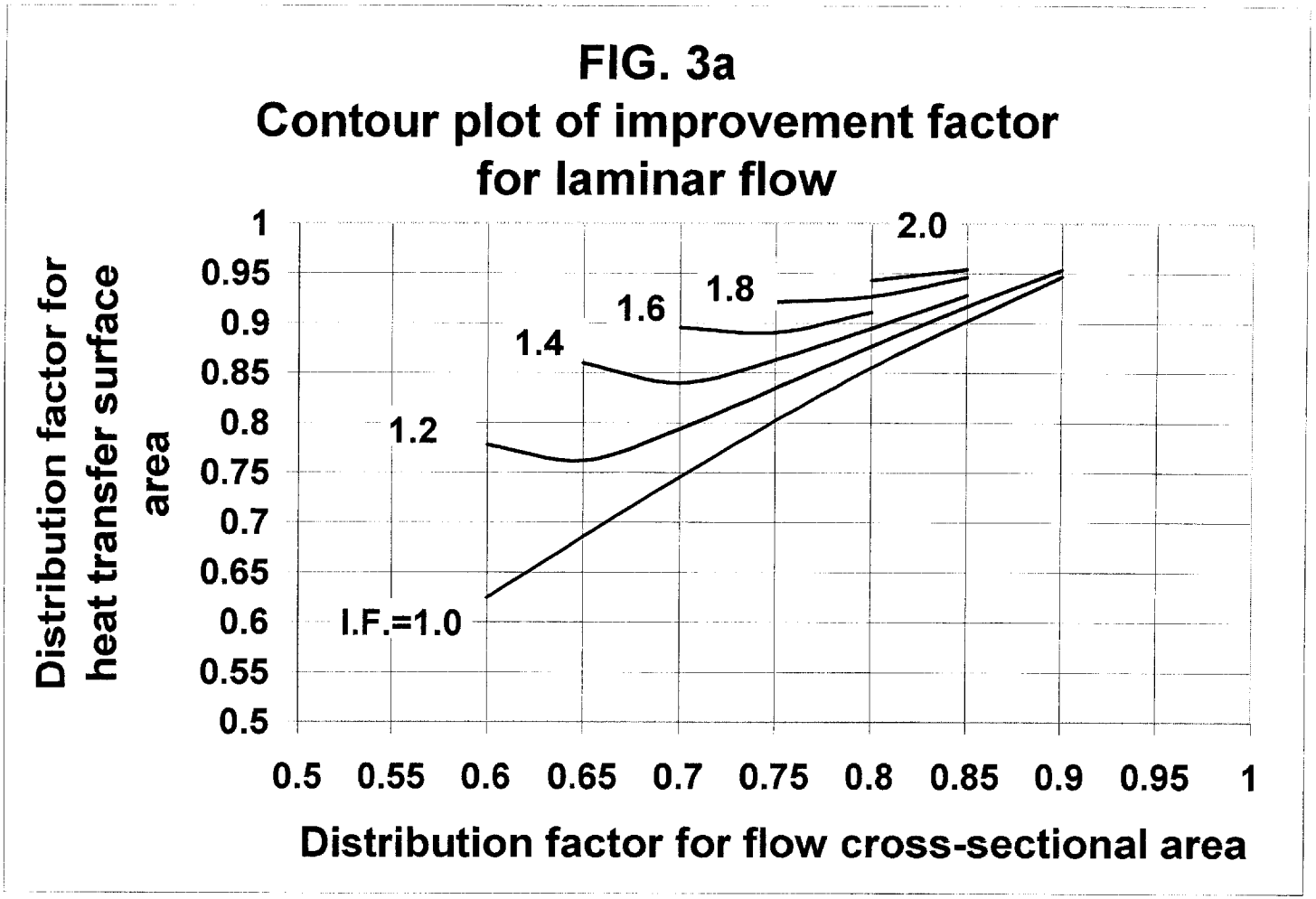
FIG. 3*a* shows the improvement factor for the improved design, for laminar flow.

The same spreadsheet which generated Table 5 can also be used to generate a contour plot of the improvement factor as a function of the two area ratios. Such a plot is shown in FIG. 3*a* for laminar flow. This shows in particular what combination of area ratios gives an improvement factor of 1.0, 1.2, 1.4, 1.6, 1.8 and 2.0. The axes of the plot are the same as the axes for Table 5.

Next, for turbulent flow, a similar table of improvement factors can be generated. These results are given in Table 6.

TABLE 6

| Improvement factor in heat transfer per unit pressure drop, for turbulent flow | | | | | | | | | | |
|---|---|---|---|---|---|---|---|---|---|---|
| Fraction of heat transfer surface area in region having majority of ht transfer | Fraction of flow cross-sectional area in region having majority of flow cross-sectional area | | | | | | | | | |
| surf area | 50% | 55% | 60% | 65% | 70% | 75% | 80% | 85% | 90% | 95% |
| 95% | 1.06 | 1.29 | 1.49 | 1.6 | 1.54 | 1.26 | 0.83 | 0.4 | 0.13 | 0.02 |
| 90% | 1.05 | 1.23 | 1.34 | 1.32 | 1.14 | 0.83 | 0.49 | 0.23 | 0.08 | 0.01 |
| 85% | 1.04 | 1.18 | 1.22 | 1.14 | 0.92 | 0.63 | 0.36 | 0.17 | 0.06 | 0.01 |
| 80% | 1.03 | 1.13 | 1.13 | 1 | 0.77 | 0.52 | 0.3 | 0.14 | 0.05 | 0.01 |
| 75% | 1.02 | 1.09 | 1.05 | 0.9 | 0.68 | 0.44 | 0.25 | 0.12 | 0.04 | 0.01 |
| 70% | 1.01 | 1.06 | 0.99 | 0.82 | 0.6 | 0.39 | 0.22 | 0.1 | 0.03 | 0.01 |
| 65% | 1.01 | 1.02 | 0.93 | 0.76 | 0.55 | 0.35 | 0.2 | 0.09 | 0.03 | 0 |
| 60% | 1 | 1 | 0.88 | 0.7 | 0.51 | 0.32 | 0.18 | 0.09 | 0.03 | 0 |
| 55% | 1 | 0.97 | 0.84 | 0.66 | 0.47 | 0.3 | 0.17 | 0.08 | 0.03 | 0 |
| 0.50 | 1 | 0.95 | 0.81 | 0.63 | 0.44 | 0.28 | 0.16 | 0.07 | 0.02 | 0 |

This table has similar general characteristics to Table 5 previously presented for laminar flow. The improvement factor of the previously presented numerical example appears in this table in the location with the wide portion having a flow area fraction of 65% and having a heat transfer area fraction of 90%, showing an improvement factor of 1.32. As in Table 5, the portion of the table having an improvement factor greater than one is approximately the upper left-hand comer of the table, but the region having an improvement factor greater than one is slightly smaller than in Table 5. In this case the peak value of improvement factor in the table is about 1.6, somewhat less than the value in the table for laminar flow. As before, the peak value of improvement factor is at the highest value of nonuniformity of heat transfer area, but the peak is at less of a nonuniformity in flow area distribution. This is because for turbulent flow, with its quadratic rather than linear dependence of pressure drop on velocity, heavy nonuniformity of flow area, which results in large velocities, results in even larger local pressure drops and so is disadvantageous. At the extreme right hand side of this table are very poor and obviously undesirable values of the improvement factor.

Figure 3B:
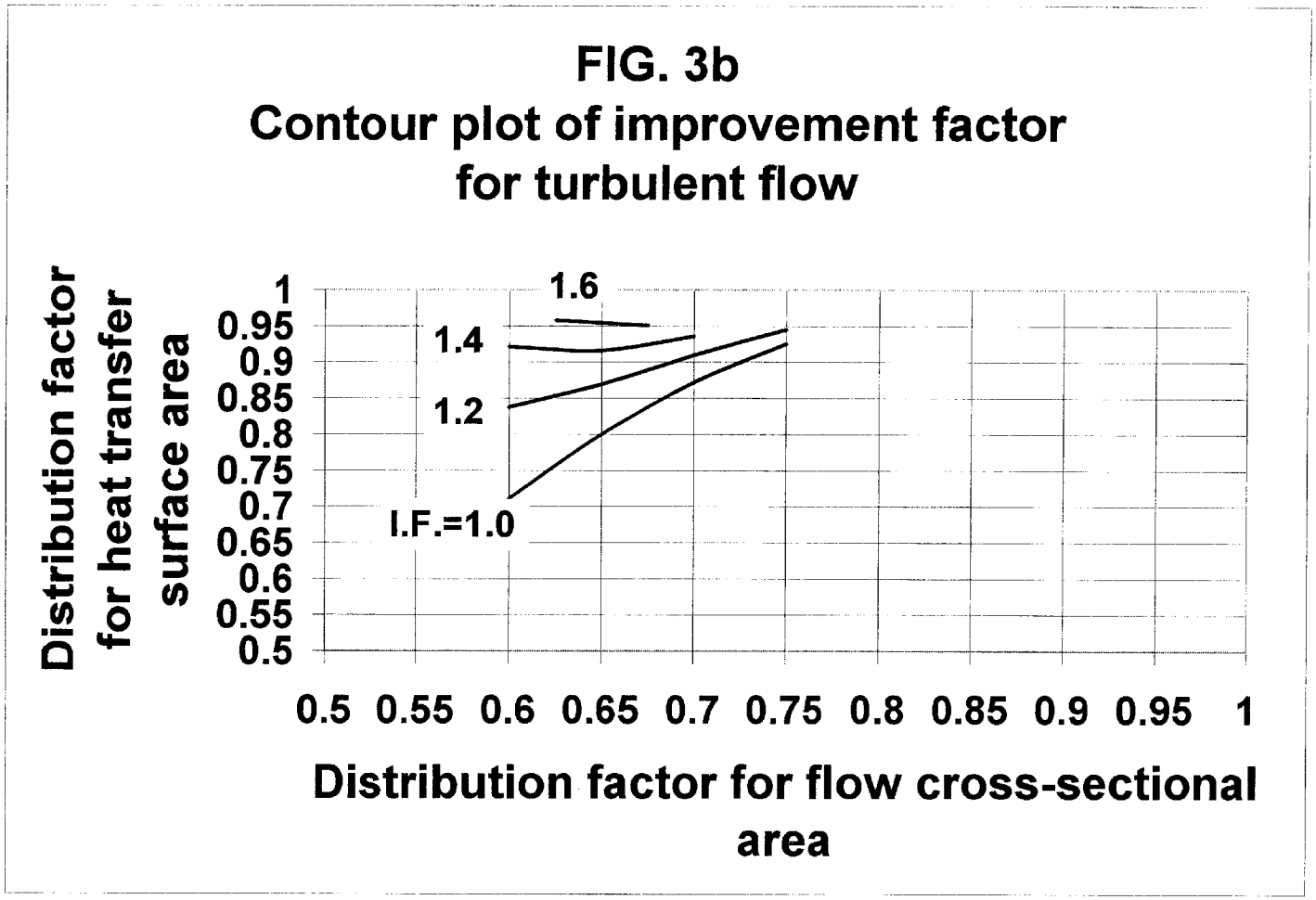
FIG. 3*b* shows the improvement factor for the improved design, for turbulent flow.

Just as before, the spreadsheet which generated Table 6 can also be used to generate a contour plot of the improvement factor, shown in FIG. 3*b* for turbulent flow. This shows in particular what combination of area ratios gives an improvement factor of 1.0, 1.2, 1.4 and 1.6. The axes of the plot are the same as the axes for Table 6.

Looking at FIGS. 3*a* and 3*b*, the region of practical interest is anywhere the improvement factor is greater than one. Although there is curvature to the contour lines and some quantitative difference between the laminar and turbulent results, it can be stated that the all of the cases showing an improvement factor greater than one lie in the upper left hand half of the table, where the heat transfer surface area distribution factor is greater than the flow cross-sectional area distribution factor. To define the region of interest as this entire half of the table includes in the case of laminar flow a slight amount of parameter space having an improvement factor less than one, and, in the case of turbulent flow a modest amount of parameter space having an improvement factor less than one. Nevertheless, this definition using the diagonal of the table is a quite simple description which comes close to in each flow regime describing the boundaries of parameter space for which the improvement factor is greater than one.

It should be noted that Tables 5 and 6 are calculated assuming that the uniformly spaced baseline case, to which comparison is being made, has a length of one characteristic length. Similar tables could be generated for other lengths for baseline cases.

Figure 4:
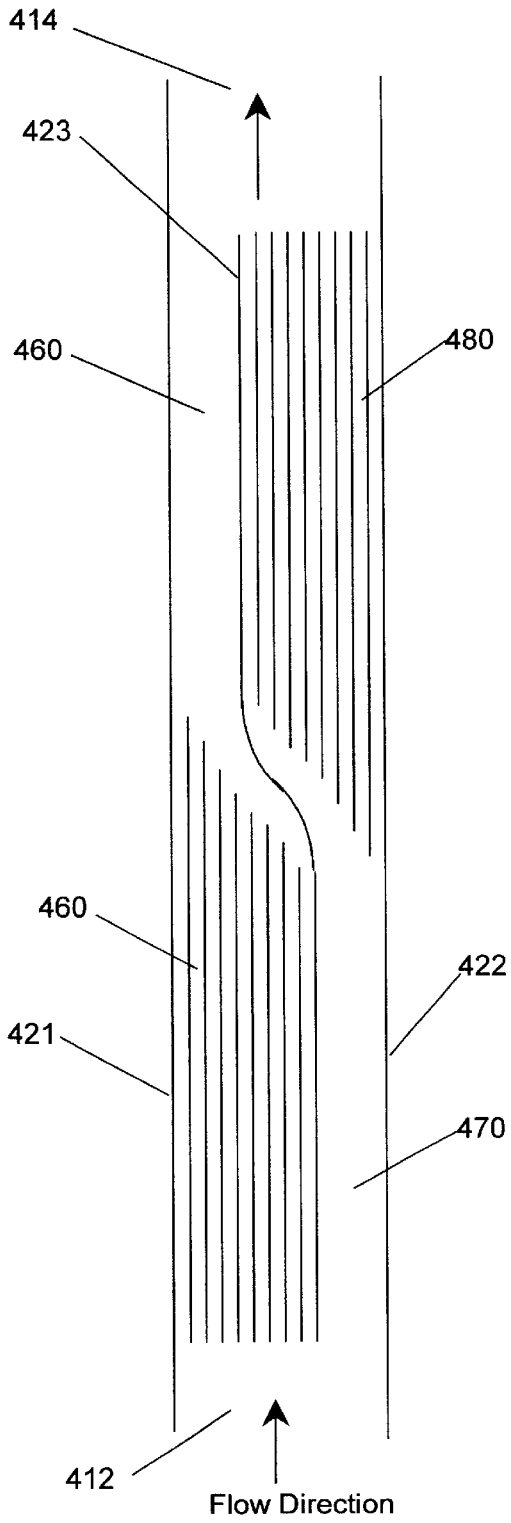
FIG. 4 shows a planar array of fins similar to FIG. 2*b*, wherein the transition between regions is made more gradual.

It can be noted that for simplicity the analysis presented here neglects pressure losses associated with change of area or velocity, commonly known as entrance or exit losses. Such losses can be minimized by smoothly shaped contouring, especially at the transition between wide and narrow regions. Also, it is likely that in at least some situations of practical interest the change of area losses are by nature insignificant compared to the pressure drops which are calculated here for the straight lengths. Also in illustrations such as FIG. 2*b* the transition region is shown as being of a short but non-zero length and a small amount of fin length is lost in order to create that transition. For simplicity, this lost fin length has been neglected here. There obviously could be situations in which the transition region is of minimal length compared to the lengths of the regions which are analyzed here, or situations in which the lengths of the various fins are adjusted so that there is exactly the same total amount of fin length (surface area) as in s the baseline case. Also, with respect to both of these nonidealities, it is quite possible that the transition of both flow area and heat transfer area could be made somewhat gradually to minimize these effects. A gradual change in flow area would minimize pressure losses, and the change in distribution of heat transfer area could be gradual so as to geometrically fit in with the gradual change in flow area and minimize the amount of missing fin length or surface. It would even be possible to add a slight amount of heat transfer surface area in the sparsely-surfaced regions just to restore exact equality of surface area. Such a gradual transition is shown in FIG. 4 with parts numbering being analogous to parts numbering in FIG. 2*b*, with numbers increased by 100. In FIG. 4, the inter-flowpath boundary 423 is gently curved near the transition from region 450 to region 460 and from region 470 to region 480. Additionally, the fins 430 within any individual region are not all of identical length but rather within an individual region are of varying length as shown in FIG. 4 so as to follow the curve of inter-flowpath boundary 423 and to provide local flow cross-sectional areas for the flows from the various passageways as they combine, which are sufficiently large that there are not unnecessary flow restrictions. At the overall entrance and exit (412 and 414 and similar in other figures), there is a region where the flow far away from the finned region may be presumed to be distributed uniformly across the cross-section, and close to the finned region the flow must distribute itself in a nonuniform distribution. It may be desirable to provide some baffle, scoop, diffuser or other form of contouring, as are known in the art, to assist this transition with minimal pressure drop.

Since the present invention has been shown to be beneficial in both laminar and turbulent flow, it can be expected that it would also be beneficial in the transition flow regime between laminar and turbulent flow. It is possible that in some designs the flow in one region is laminar while the flow in another region is turbulent, or the flow in either or both regions might be in the transition regime. The present invention should in general be beneficial in any combination of flow regimes for the various regions. The correlations for heat transfer and pressure drop would be slightly different depending on what flow regime exists in what region, and so the optimum values of distribution factors for situations involving combinations of flow regimes would be slightly different from what has already been presented in the examples.

Figure 5:
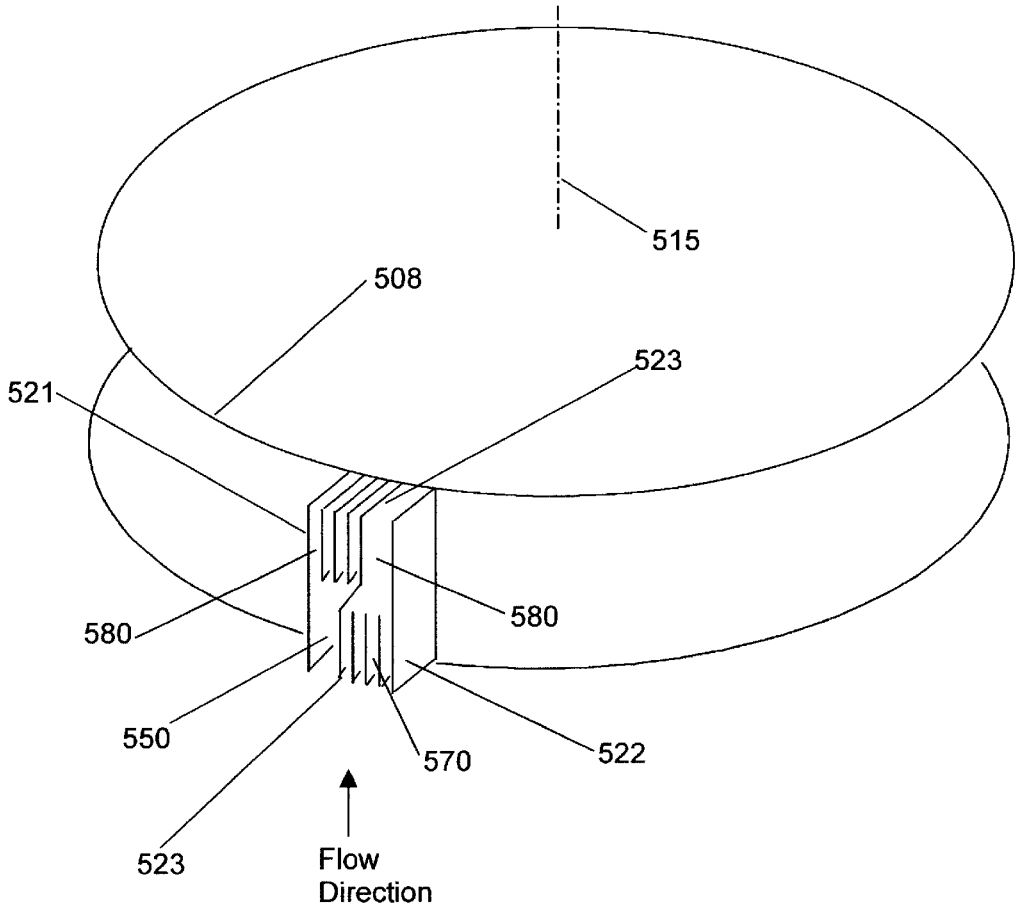
FIG. 5 shows an array of fins arrayed around a cylinder, with flow in the vertical or axial direction, which could be used with either forced or natural convection.

The present invention should also be useful with natural convection heat transfer. In natural convection there is no pump or fan or active source of fluid motion. However, there still is a driving force and it still is useful to think in terms of flow resistance and how much flowrate is achieved for a given pressure drop. The source of fluid motion is a pressure difference between the inlet and the outlet of the flowpath past the fins, and that pressure difference is determined by the buoyancy of the fluid (change in fluid density per unit change in fluid temperature), the body force (which in ordinary situations is the acceleration of gravity), the height of the heated region along the direction of the body force, and the actual magnitude of temperature differences. It can also be influenced to some extent by the spatial distribution of temperature of the fluid. If this available pressure difference can be spent more efficiently to obtain h*A*(Twall-Tfluid), then heat transfer performance will be improved, just as in forced convection the pressure difference available from a pump or fan can be spent more effectively using the present invention. In other words, the actual source of the pressure difference, whether it be buoyancy or pump or fan, is immaterial. In the present invention used with natural convection, the distribution of temperature in the fluid is different for the two flowpaths. In one flowpath the fluid temperature changes a lot in the first (entering) half of the flowpath and only a little in the second (exiting) half of the flowpath. In the other flowpath the temperature changes a little in the first half and a lot in the second half. In natural convection, these differences in temperature profile would result in unequal pressure differences for the two flowpaths and hence unequal buoyancy-driven flowrates in the two flowpaths. Minor design changes might be desirable to compensate for this, resulting in less geometric symmetry between the two flowpaths. In natural convection the general flow direction is in the direction of the body force vector, which in ordinary circumstances is the direction of gravity, i.e., the vertical direction. Thus, when the present invention is used with natural convection, it would typically be used such that the principal direction of the fins is vertical or at least has a substantial vertical component. FIG. 5 shows the present invention embodied in generally vertical fins around a cylindrical object having a vertical axis. All of the parts numbers in FIG. 5 are analogous to those in FIG. 2*b*, with the addition of a generally cylindrical central source of heat or cold having a cylindrical axis 515. The flow direction is generally vertical (either upward or downward, depending on the direction of temperature difference). In this example the pattern of paired parallel flowpaths of the present invention would be repeated many times around the circumference of the object but, for simplicity of illustration, it is only shown once. For simplicity of illustration, in this and subsequent illustrations the numbers of passageways in a unit array are shown as 3 and 1, rather than what was used in the numerical example.

It has been described that the invention can be used with either forced convection or natural convection. It is possible that in some applications where natural convection heat transfer is presently inadequate and forced convection must be employed, perhaps using the present invention natural convection can be improved to the point where it is adequate and a fan or pump is no longer necessary, with consequent design simplification. Also, there is a situation referred to as mixed convection, in which both natural and forced convection are nonnegligible, and the present invention should be applicable there as well.

Figure 6:
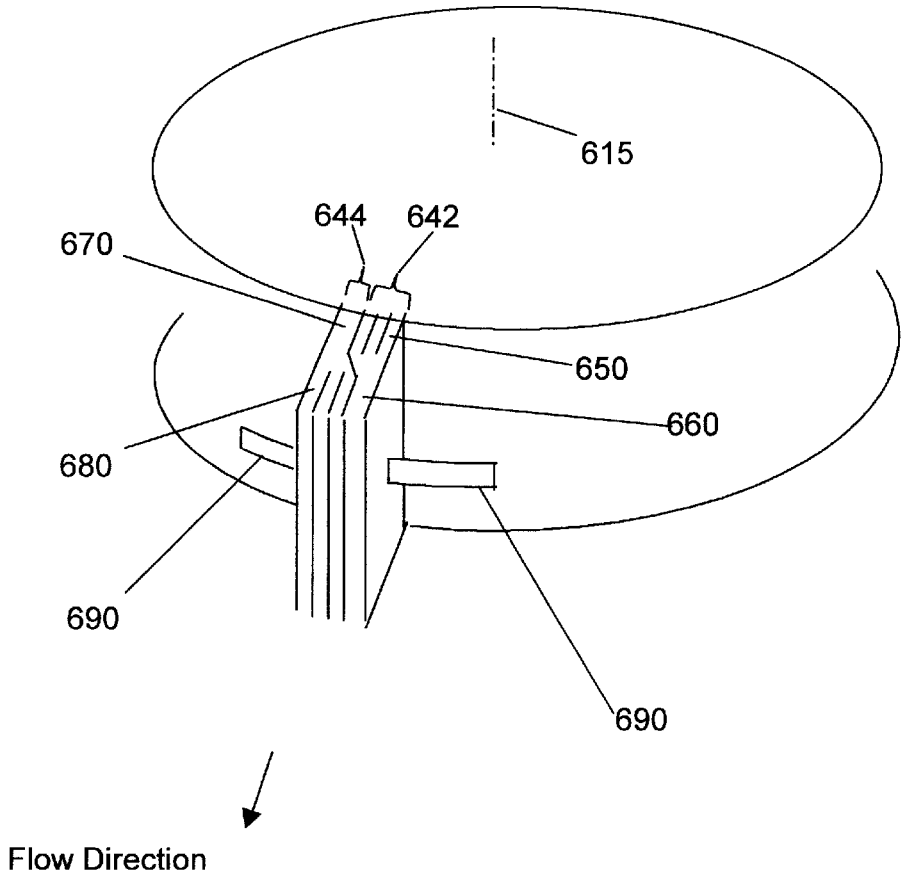
FIG. 6 shows the present invention applied to a cylindrical geometry with flow in the radial direction, using essentially planar fins, in which the surfaces of the fins are parallel to the axis of the cylinder.
Figure 7:
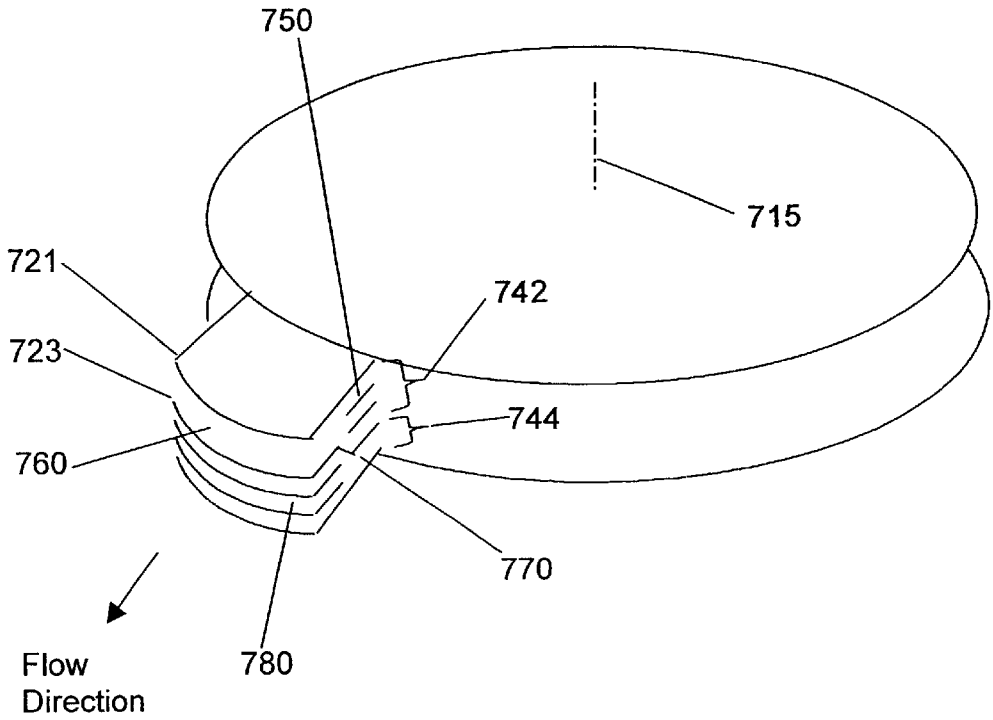
FIG. 7 shows the present invention applied to a cylindrical geometry with flow in the radial direction, using essentially planar fins, in which the surfaces of the fins are perpendicular to the axis of the cylinder.

In some heat transfer designs, the heat transfer geometry has an overall cylindrical geometry and the principal flow direction is radial with respect to that overall geometry. This arrangement is frequently used in the compressor unit of home central air conditioning units. Although the overall direction of flow is radial with respect to the overall geometry, typically the curvature of the fin array is gentle enough (radial flow path length << radius of cylindrical geometry) so that locally the flow is essentially equivalent to flow past flat plates. The present invention can be used in this situation as shown in FIGS. 6 and 7. In FIG. 6 the cylindrical geometry has an axis 615 and the orientation of the fins is such that the major surfaces of the fins are parallel to the axis 615. The flow direction is shown as being radially outward. There is first flowpath 642 and, in parallel with it, second flowpath 644. Flowpath 642 comprises first region 650 followed by second region 660 located more radially outward. Flowpath 644 comprises third region 670 followed by fourth region 680 located more radially outward. Optionally, these fins may be punctured in selected locations for the passage of an object such as a circumferentially-oriented fluid-carrying tube (not shown) which participates in the heat transfer. The flow direction is radial, either inward or outward (labeled in FIG. 6 as outward). The geometric pattern of the fins comprising paired first and second flowpaths may be repeated a number of times so as to cover a large surface. In FIG. 6, for clarity of illustration only a portion of the circumference is shown as having fins but it is be understood that most likely the entire circumference would have fins. FIG. 6. also shows a fluid-carrying tube 690 puncturing the fins. FIG. 6 also shows a fluid-carrying tube 690 puncturing the fins.

In FIG. 7 the orientation of the fins is such that the surface of each fin is substantially perpendicular to the cylindrical axis 715. Again, the flow direction is radial, either inward or outward (labeled in FIG. 7 as outward). There is a first flowpath 742 bounded by first flowpath boundary 721 and the inter-flowpath boundary 723. There is a second flowpath 744 bounded by inter-flowpath boundary 723 and second flowpath boundary 722. Similar to previous examples, flowpath 742 comprises regions 750 and 760, and flowpath 744 comprises regions 770 and 780. In FIG. 7, only a portion of the cylindrical space is shown as being occupied by fins, for clarity of illustration.

Figure 8:
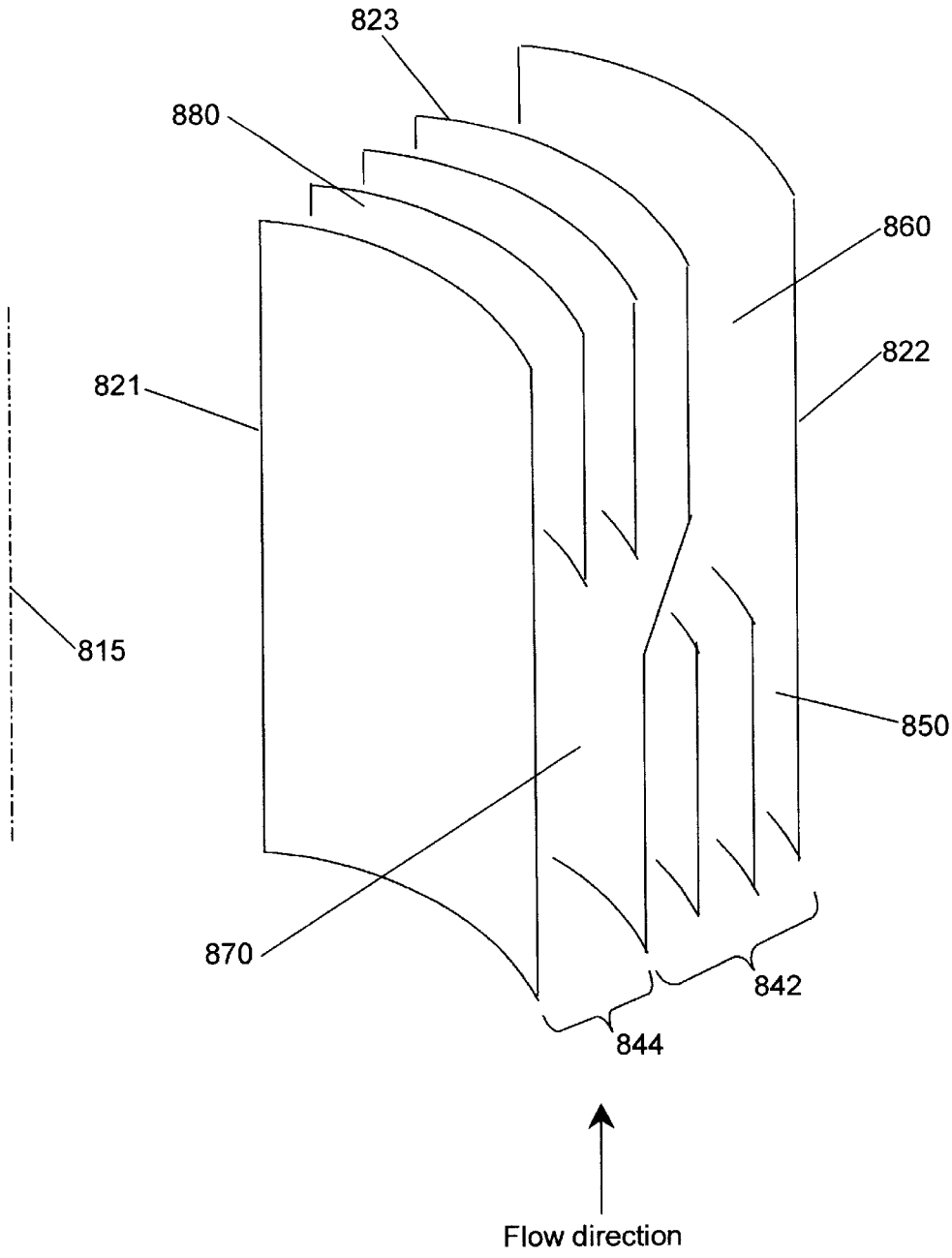
FIG. 8 shows an array of curved fins of the present invention with flow along the straight direction of the fins.

The invention has been described here with reference to flow between flat parallel plates or fins. It is also readily applicable to a related geometry, that of flow between plates or fins which are curved in one direction. If, for example, direction of flow is along the straight direction of the curved fins, the situation would be as shown in FIG. 8. Such an arrangement of fins, in a cylindrical geometry with flow in the axial direction, is described in my copending patent application filed on the same day as this application, titled "Heat Exchanger Having Curved Fins." In such a design, there would be regions with curved fins closer together and regions with curved fins further apart. There would again be paired flowpaths. In one of the parallel paths (842) the fluid would flow between closer-together curved fins (region 850) followed by further-apart curved fins (region 860), and in another of the parallel paths the fluid would flow between further-apart curved fins (region 870) followed by closer-together curved fins (region 880). The cylindrical geometry would have axis 815 and the flow direction would be parallel to axis 815.

Figure 9:
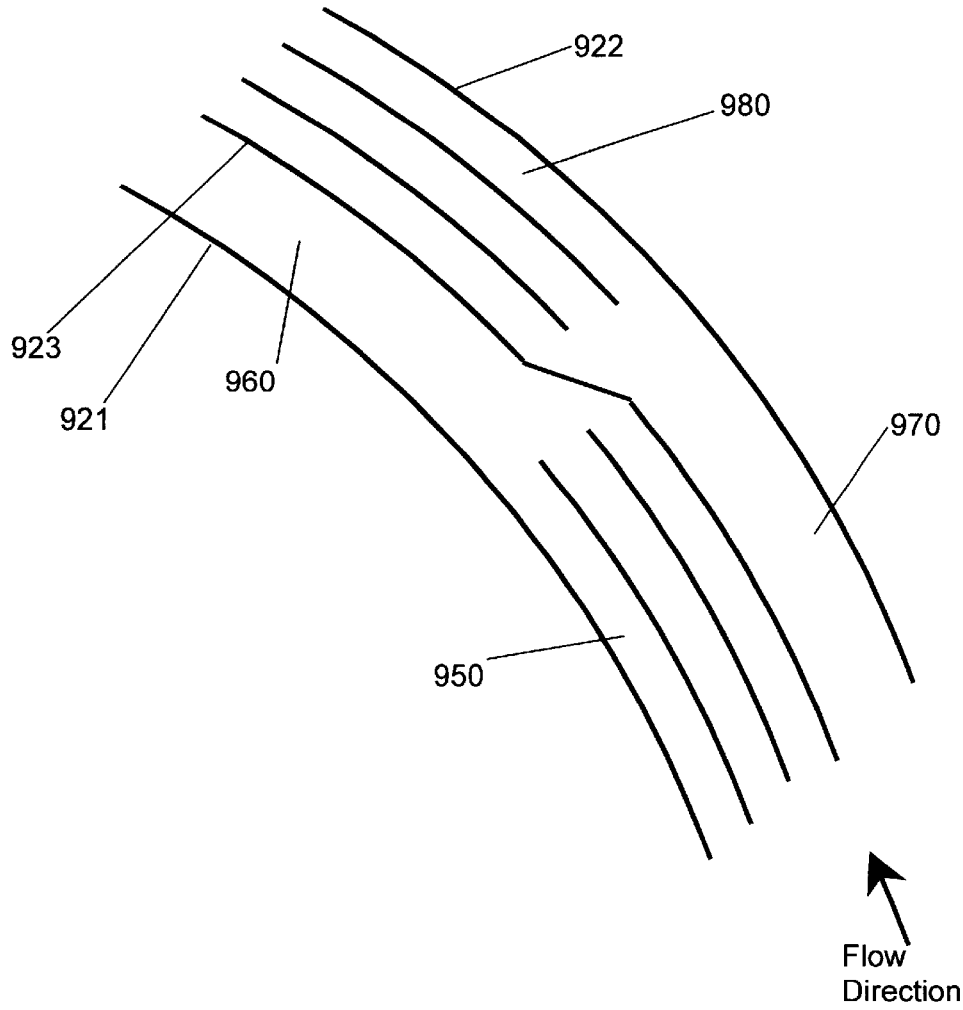
FIG. 9 shows an array of curved fins of the present invention with flow along the curved direction of the fins.

Alternatively, the orientation of curvature could instead be such that the direction of flow is along the curved direction of the curved fins, i.e., the flowpath is itself a slightly curved path. This is shown in FIG. 9, with only a two-dimensional view being shown because the geometry is extends identically into and out of the plane of the paper. In FIG. 9, there is a flowpath comprising wide densely-surfaced region 950 in series with narrow sparsely-surfaced region 960. In parallel it there is a flowpath comprising narrow sparsely-surfaced region 970 in series with wide densely-surfaced region 980. The flowpaths are bounded by left channel boundary 921, right channel boundary 922, and inter-flowpath boundary 923. For pressure drop and heat transfer, correlations and corrections are known which predict the results in this situation of flow in a channel which curves along the direction of flow. The results would be slightly different from what has been presented for straight channel flow.

Figure 10:
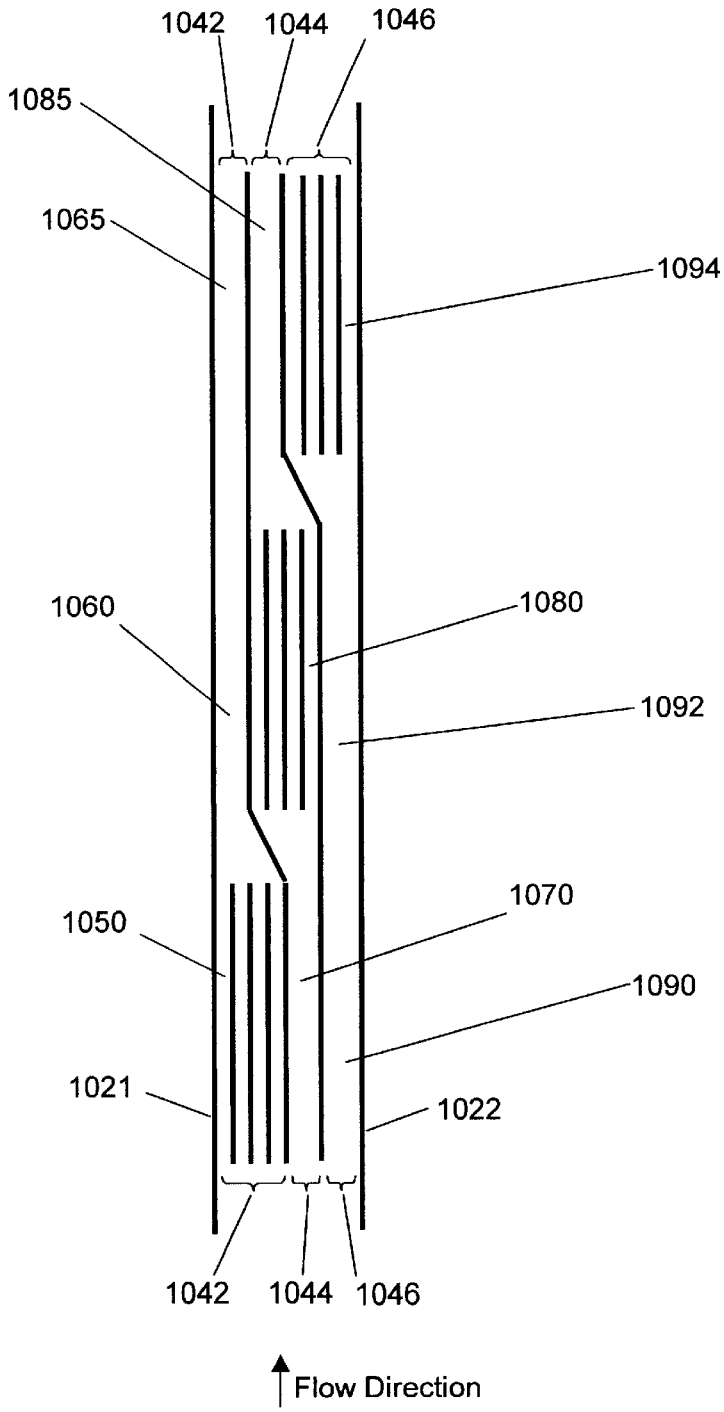
FIG. 10 shows the present invention with three flowpaths, rather than two flowpaths, all in parallel.

In all of the description so far, the invention has been described as having two flowpaths in parallel. However, it could also have three or more flowpaths in parallel, with each flowpath having a wide densely-surfaced region and, elsewhere, a sparsely-surfaced region or regions so as to carry flow around the other regions of the array with minimal pressure drop. An example showing three parallel flowpaths and three regions of fins is shown in FIG. 10. There are flowpaths 1042, 1044 and 1046. Flowpath 1042 comprises wide densely-surfaced region 1050 followed by narrow sparsely-surfaced region 1060 followed by narrow sparsely-surfaced region 1065. Flowpath 1044 comprises narrow sparsely-surfaced region 1070 followed by wide densely-surfaced region 1080 followed by narrow sparsely-surfaced region 1085. Flowpath 1046 comprises narrow sparsely-surfaced region 1090 followed by narrow sparsely-surfaced region 1092 followed by wide densely-surfaced region 1094. In view of the fact that for laminar flow in Table 5 there was achieved a possible laminar flow improvement factor in the range of 2, it may be expected that this design could achieve a improvement factor in the range of as much as 3.

Figure 11:
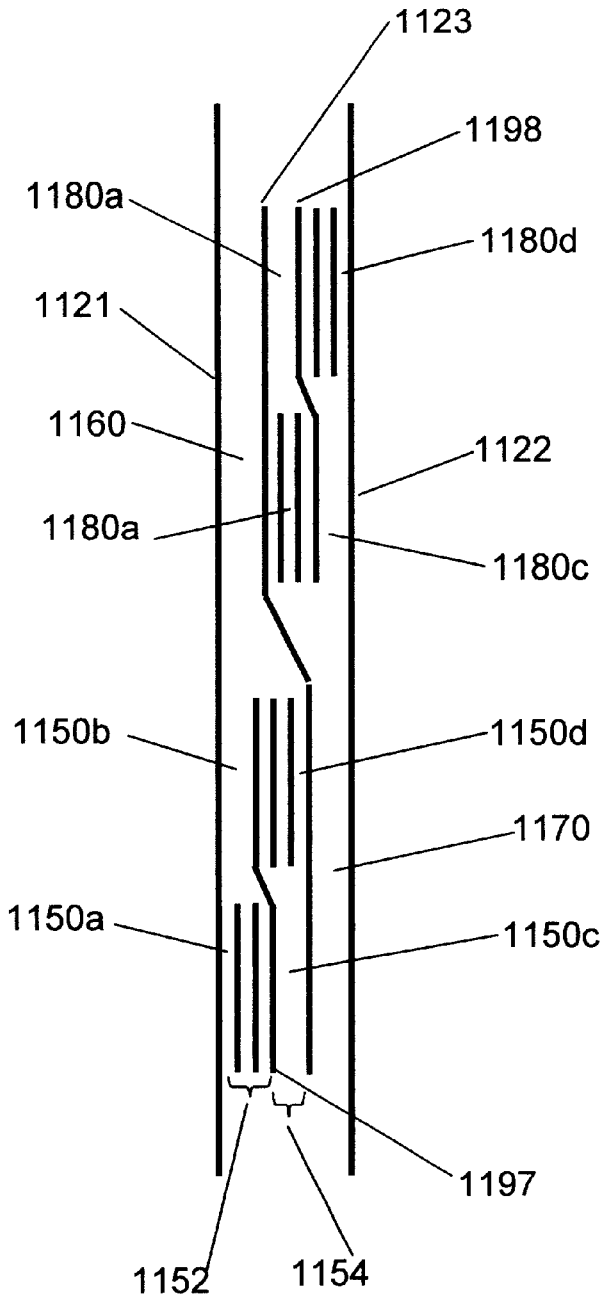
FIG. 11 shows the present invention with two flowpaths, in which some regions are themselves composed of arrays of parallel flowpaths according to present invention.

It would also be possible for any one or more of the four regions used in the description to itself be an array of sub-regions using the described invention. This is shown in FIG. 11. In this illustration each of the wide densely-surfaced regions (heat transfer regions) 1150 and 1180 is itself made up of an array of sub-regions. Region 1150 comprises sub-flowpaths 1152 and 154 in parallel with each other. Sub-flowpath 1152 comprises sub-regions 1150*a* and 1150*b* in series with each other, with sub-region 1150*a* being wider and densely-surfaced and sub-region 1150*b* being narrower and sparsely-surfaced. Sub-flowpath 1154 comprises sub-regions 1150*c* and 1150*d* in series with each other, with sub-region 1150*c* being narrower and sparsely-surfaced and sub-region 1150*d* being wider and densely-surfaced. Sub-flowpaths 1152 and 1154 are separated by inter-sub-flowpath separator 1197. Similar construction and numbering describe subdivisions within region 1180. In view of the fact that for laminar flow in Table there was achieved a possible laminar flow improvement factor in the range of 2, it may be expected that this design could achieve a improvement factor in the range of as much as the square of that, or 4.

The heat transfer surface has been described so far as being fins which have a flat surface in at least one direction, but it could also be something other than fins as long as the design accomplishes varying amounts of heat transfer surface area per unit of flow cross-sectional area. For example, each individual region could be porous heat transfer surfaces of unequal pore size, wire mesh of unequal wire packing density or other design parameters, pins of unequal pin spacing or other dimension, tubes in a crossflow shell and tube heat exchanger, etc. Each individual region could be an array of tubes in parallel, possibly with flow through them as in a shell-and-tube heat exchanger, with the amount of heat transfer surface per unit volume being determined by the diameter or shape of the tubes in an individual region. Each individual region could be an array of pins of appropriate spacing distance between them. Fins could be perforated. Just as in the other examples, there would be one parallel flowpath in which flow passes through a more densely-packed region followed by a less densely-packed region, and there would be another parallel flowpath in which flow passes through a less densely-packed region followed by a more densely-packed region. It is even possible that the inter-flowpath boundary be less than perfectly solid, although this would hurt performance. Any of the fin designs could be punctured in selected locations to accept, for example, a fluid-carrying tube which participates in the heat transfer by bring heat to or from the fins. Such an arrangement is common in radiators or other liquid-to-gas heat exchangers. The left and right channel boundaries and the inter-flowpath boundary could be heat transfer surfaces as has been assumed in the examples, or they do not have to be heat transfer surfaces.

The invention has been discussed using one example in which the flow was laminar in all regions and another example in which the flow was turbulent in all regions. Of course, the invention is also applicable if the flow in any region is transition regime flow, and in general for any regime of flow (laminar, transition, turbulent) in any of the regions and any combination of flow regimes in the various regions. The only difference would be in details of the fluid flow correlation, the heat transfer correlation, and the optimum geometric variables. Also, the invention has been described here using examples with symmetry, i.e., the first and fourth regions were identical to each other, as were the second and third regions. Although this symmetry is convenient, it is possible for there to be asymmetries among the regions. The numerical examples have all been calculated for incompressible flow. However, the calculation could readily be extended to compressible flow. Although the term velocity has been used in various discussions herein, for compressible flow mass flux would be a more relevant term than velocity. The fluid has been described in the examples as being air or water. Of course, the fluid could be any fluid, either liquid or gas, or in appropriate conditions a supercritical fluid or a multi-phase fluid. The direction of heat transfer could be either to or from the fluid, i.e., either heating or cooling.

Applications discussed so far include heat exchangers having one gas side or one side having a significant thermal resistance. However, the present invention is equally applicable to gas-to-gas heat exchangers which would have significant thermal resistance on both sides, and in general to any heat exchanger or heat exchange device or heat sink of any thermal resistance. It could be used on both sides of a fluid-to-fluid heat exchanger, in addition to just one side. Applications include liquid-to-gas heat exchangers, gas-to-gas heat exchangers, evaporators, condensers, air conditioning and heating equipment, vehicular radiators, heat sinks for electronics, process equipment, electrical generating plants in which the circulating fluid is gas, electrical generating plants which reject heat to the atmosphere, etc. The application could also be liquid-to-liquid or other non-gas heat exchangers, even though for these the pumping power would be less of a critical factor than it is with gaseous heat exchange.

The present invention may also be described as a method for improving heat transfer compared to pressure drop, comprising flowing the fluid through two or more flowpaths fluid mechanically in parallel with each other, wherein each flowpath has in series a heat transfer region and one or more fluid flow regions as have already been described.

Although various embodiments of the invention have been disclosed and described in detail, it should be understood that this invention is in no way limited thereby and its scope is to be determined by that of the appended claims.

I claim:

1. An apparatus for engaging in heat transfer with a flowing fluid, comprising:

a first channel boundary which is a heat transfer surface and an interchannel boundary which is a heat transfer surface, the first channel boundary and the interchannel boundary at least partially defining a first channel which is configured to confine a first channel flow of the fluid, the first channel boundary and the interchannel boundary both being disposed to engage in heat transfer with the fluid in the first channel; and a second channel boundary which is a heat transfer surface, located such that the interchannel boundary is between the first channel boundary and the second channel boundary, the second channel boundary and the interchannel boundary at least partially defining a second channel which is configured to confine a second channel flow of the fluid, the second channel boundary and the interchannel boundary both being disposed to engage in heat transfer with the fluid in the second channel, the first channel comprising a first channel upstream region having a first channel upstream region flow cross-sectional area, in series with a first channel downstream region having a first channel downstream region flow cross-sectional area, the second channel comprising a second channel upstream region having a second channel upstream region flow cross-sectional area, in series with a second channel downstream region having a second channel downstream region flow cross-sectional area, the first channel upstream region flow cross-sectional area being greater than the first channel downstream region flow cross-sectional area, the second channel downstream region flow cross-sectional area being greater than the second channel upstream region flow cross-sectional area, and further comprising, the first channel upstream region, additional first channel upstream region heat transfer surface disposed to engage in heat transfer with the fluid in the first channel upstream region, and, in the second channel downstream region, additional second channel downstream region heat transfer surface disposed to engage in heat transfer with the fluid in the second channel downstream region, wherein the first channel upstream region has a first channel upstream region total heat transfer surface area in contact with the fluid in the first channel upstream region, and the first channel downstream region has a first channel downstream region total heat transfer surface area in contact with the fluid in the first channel downstream region, and the second channel upstream region has a second channel upstream region total heat transfer surface area in contact with the fluid in the second channel upstream region, and the second channel downstream region, has a second channel downstream region total heat transfer surface area in contact with the fluid in the second channel downstream region, and wherein the first channel upstream region total heat transfer surface area and the second channel upstream region total heat transfer surface area define a heat transfer surface area distribution factor which is the larger of those two quantities divided by their sum, and the first channel upstream region flow cross-sectional area and the second channel upstream region flow cross-sectional area define a flow cross-sectional area distribution factor which is the larger of those two quantities divided by their sum, and wherein the heat transfer surface area distribution factor is greater than the flow cross-sectional area distribution factor.

2. The apparatus of claim 1, wherein the first channel flow of the fluid has a first channel flowrate and the second channel flow of the fluid has a second channel flowrate, and the first channel flowrate and the second channel flowrate are substantially equal to each other.

3. The apparatus of claim 1, wherein the first channel flow of the fluid has a first channel flowrate and the second channel flow of the fluid has a second channel flowrate, and the first channel flowrate and the second channel flowrate are substantially equal to each other.

4. The apparatus of claim 1, wherein the additional first channel upstream region heat transfer surface is substantially similar to the additional second channel downstream region heat transfer surface.

5. The apparatus of claim 1, wherein either the first channel upstream region or the second channel downstream region, or both, comprises:

a first sub-channel comprising a first sub-channel upstream region having a first sub-channel upstream region flow cross-sectional area, in series with a first sub-channel downstream region having a first sub-channel downstream region flow cross-sectional area, the first sub-channel having boundaries disposed to engage in heat transfer with the fluid in the first sub-channel, and, in parallel with the first sub-channel, a second sub-channel comprising a second sub-channel upstream region having a second sub-channel upstream region flow cross-sectional area, in series with a second sub-channel downstream region having a second sub-channel downstream region flow cross-sectional area, the second sub-channel having boundaries disposed to engage in heat transfer with the fluid in the second sub-channel, and, in the first sub-channel upstream region, additional first sub-channel upstream region heat transfer surface disposed to engage in heat transfer with a first sub-channel fluid, and, in the second sub-channel downstream region, additional second sub-channel downstream region heat transfer surface disposed to engage in heat transfer with a second sub-channel fluid.

6. The apparatus of claim 1, further comprising a gradual transition between the first channel upstream region and the first channel downstream region, and a gradual transition between the second channel upstream region and the second channel downstream region.

7. The apparatus of claim 1, wherein the additional first channel upstream region heat transfer surface is configured as fins which are substantially parallel to the first channel boundary, and the additional second channel downstream region heat transfer surface is configured as fins which are substantially parallel to the second channel boundary.

8. The apparatus of claim 1, wherein the heat transfer surface area comprises fins which are flat in a first fin direction and curved in a second fin direction perpendicular to the first fin direction, and the flow of the first channel fluid and the flow of the second channel fluid have a common overall flow direction, and the overall flow direction is substantially along the first fin direction.

9. The apparatus of claim 1, wherein the heat transfer surface area comprises fins which are flat in a first fin direction and curved in a second fin direction perpendicular to the first fin direction, and the flow of the first channel fluid and the flow of the second channel fluid have a common overall flow direction, and the overall flow direction is substantially along the second fin direction.

10. The apparatus of claim 1, wherein the additional first channel upstream region heat transfer surface, or the additional second channel downstream region heat transfer surface, or both, comprises perforated fins, or one or more fins punctured by one or more fluid-carrying tubes, or wire mesh, or a porous material, or pins, or tubes in crossflow, or tubes in other geometries.

11. The apparatus of claim 1, wherein the apparatus is repeated a plurality of times side-by-side.

12. The apparatus of claim 1, wherein the flow in the first channel upstream region is in a regime which is selected from the group consisting of laminar flow, turbulent flow and transition regime flow, and the flow in the first channel downstream region is in a regime which is selected from the group consisting of laminar flow, turbulent flow and transition regime flow.

13. The apparatus of claim 1, wherein the fluid is selected from the group consisting of: a gas; a liquid; a mixture of an evaporating liquid and a gas; a mixture of a condensing gas and a liquid; a multi-phase fluid; and a supercritical fluid.

14. The apparatus of claim 1, wherein the flow is forced convection driven by a pump, fan, blower, impeller or compressor, or natural convection, or mixed convection.

15. The apparatus of claim 1, wherein the apparatus is part of a liquid-to-gas heat exchanger, an evaporator, a condenser, air conditioning or heating equipment, a vehicular radiator, a gas-to-gas heat exchanger, a heat sink for electronics or other purposes, process equipment, a process or power plant in which the circulating fluid is a gas, a process or power plant which rejects heat to the atmosphere, or a liquid-to-liquid heat exchanger.

16. The apparatus of claim 1, wherein the apparatus has a cylindrical geometry having an axial direction and a radial direction, and the first channel flow of the fluid and the second channel flow of the fluid have a common overall flow direction, and the overall flow direction is in the radial direction of the cylindrical geometry.

17. The apparatus of claim 1, wherein every point on every fin or heat transfer surface has a local surface temperature, and adjacent to every such point the fluid has a local fluid temperature, and the local surface temperature is everywhere greater than or equal to the local fluid temperature.

18. A method of promoting heat transfer with a flowing fluid, comprising passing the fluid through the apparatus of claim 1.

19. The apparatus of claim 1, wherein the heat transfer surface area distribution factor is greater than approximately 85% and the flow cross-sectional area distribution factor is between approximately 65% and 85%.

20. The apparatus of claim 1 wherein:

the first channel upstream region total heat transfer surface area is the sum of the surface area of the first channel boundary in contact with the fluid in the first channel upstream region, plus the surface area of the interchannel boundary in contact with the fluid in the first channel upstream region, plus the surface area of the additional first channel upstream region heat transfer surface; and the first channel downstream region total heat transfer surface area is the sum of the surface area of the first channel boundary in contact with the fluid in the first channel downstream region, plus the surface area of the interchannel boundary in contact with the fluid in the first channel downstream region; and the second channel upstream region total heat transfer surface area is the sum of the surface area of the interchannel boundary in contact with the fluid in the second channel upstream region, plus the surface area of the second channel boundary in contact with the fluid in the second channel upstream region; and the second channel downstream region total heat transfer surface area is the sum of the surface area of the interchannel boundary in contact with the fluid in the second channel downstream region, plus the surface area of the second channel boundary in contact with the fluid in the second channel downstream region, plus the surface area of the additional second channel downstream region heat transfer surface.

21. The apparatus of claim 1, wherein the first channel upstream region flow cross-sectional area substantially equals the second channel downstream region flow cross-sectional area and the first channel downstream region flow cross-sectional area substantially equals the second channel upstream region flow cross-sectional area.

22. The apparatus of claim 1, wherein one or more of the left channel boundary, the right channel boundary and the interchannel boundary comprises a fin punctured by one or more fluid-carrying tubes.

23. The apparatus of claim 1, further comprising, in the first channel, a first channel extreme downstream region downstream of the first channel downstream region and substantially resembling the first channel downstream region, and in the second channel, a second channel extreme downstream region downstream of the second channel downstream region and substantially resembling the second channel upstream region, and further comprising a third channel boundary which is a heat transfer surface, the third channel boundary and the second channel boundary at least partially defining a third channel which is configured to confine a third channel flow of the fluid, the second channel boundary and the third boundary both being disposed to engage in heat transfer with the fluid in the third channel, the third channel being in parallel with the first channel and the second channel, the third channel comprising a third channel upstream region having a third channel upstream region flow cross-sectional area, in series with a third channel downstream region substantially resembling the third channel upstream region and having a third channel downstream region flow cross-sectional area, in series with a third channel extreme downstream region having third channel extreme downstream region flow cross-sectional area, the third channel extreme downstream region flow cross-sectional area being greater than the third channel downstream region flow cross-sectional area, and further comprising, in the third channel extreme downstream region, additional third channel extreme downstream region heat transfer surface disposed to engage in heat transfer with the fluid in the third channel extreme downstream region.

24. The apparatus of claim 1, wherein every point on every fin or heat transfer surface has a local surface temperature, and adjacent to every such point the fluid has a local fluid temperature, and the local surface temperature is everywhere less than or equal to the local fluid temperature.

25. An apparatus for engaging in heat transfer with a flowing fluid, comprising:

a first channel boundary which is a heat transfer surface and an interchannel boundary which is a heat transfer surface, the first channel boundary and the interchannel boundary at least partially defining a first channel which is configured to confine a first channel flow of the fluid, the first channel boundary and the interchannel boundary both being disposed to engage in heat transfer with the fluid in the first channel; and a second channel boundary which is a heat transfer surface, located such that the interchannel boundary is between the first channel boundary and the second channel boundary, the second channel boundary and the interchannel boundary at least partially defining a second channel which is configured to confine a second channel flow of the fluid, the second channel boundary and the interchannel boundary both being disposed to engage in heat transfer with the fluid in the second channel, the first channel comprising a first channel upstream region having a first channel upstream region flow cross-sectional area, inscribes with a first channel downstream region having a first channel downstream region flow cross-sectional area, the second channel comprising a second channel upstream region having a second channel upstream flow cross-sectional area, in series with a second channel downstream region having a second channel downstream region flow cross-sectional area, the first channel upstream region flow cross-sectional area being greater than the first channel downstream region flow cross-sectional area, the second channel downstream region flow cross-sectional area being greater than the second channel upstream region flow cross-sectional area, and further comprising, in the first channel upstream region, additional first channel upstream region heat transfer surface disposed to engage in heat transfer with the fluid in the first channel upstream region, and, in the second channel downstream region, additional second channel downstream region heat transfer surface disposed to engage in heat transfer with the fluid in the second channel downstream region, wherein the apparatus has a cylindrical geometry having an axial direction and a radial direction, and the first channel flow of the fluid and the second channel flow of the fluid have a common overall flow direction, and the overall flow direction is in the radial direction of the cylindrical geometry.

* * * * *